US009037049B2

(12) United States Patent
Okubo

(10) Patent No.: US 9,037,049 B2
(45) Date of Patent: May 19, 2015

(54) DEVELOPING DEVICE, AND IMAGE FORMING APPARATUS USING THE SAME

(71) Applicant: FUJI XEROX CO., LTD., Tokyo (JP)

(72) Inventor: Munenobu Okubo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 105 days.

(21) Appl. No.: 13/888,728

(22) Filed: May 7, 2013

(65) Prior Publication Data

US 2014/0147143 A1 May 29, 2014

(30) Foreign Application Priority Data

Nov. 27, 2012 (JP) ..... 2012-259181

(51) Int. Cl.
*G03G 15/08* (2006.01)

(52) U.S. Cl.
CPC ..... *G03G 15/0808* (2013.01); *G03G 15/0891* (2013.01)

(58) Field of Classification Search
CPC ..... G03B 13/095; G03B 15/0839; G03B 15/0832
USPC ..... 399/53, 252
See application file for complete search history.

(56) References Cited

U.S. PATENT DOCUMENTS

2007/0286648 A1* 12/2007 Sano et al. ..... 399/281

FOREIGN PATENT DOCUMENTS

| | | |
|---|---|---|
| JP | A-61-159675 | 7/1986 |
| JP | A-2002-72682 | 3/2002 |
| JP | A-2009-25493 | 2/2009 |

* cited by examiner

*Primary Examiner* — David Bolduc
*Assistant Examiner* — Barnabas Fekete
(74) *Attorney, Agent, or Firm* — Oliff PLC

(57) ABSTRACT

A developing device includes a transporting unit that rotates while being opposed to an image holding member and that transports a developer toward the image holding member to develop the electrostatic latent image on the image holding member, a supplying unit that has the developer adhered onto a circumferential surface thereof being rotated and that supplies the developer to the transporting unit in contact with the transporting unit, and a replenishing unit that includes a transporting path connected between a containing chamber and supplying chamber, that keeps the developer, with which the supplying unit is replenished, remaining, and that replenishes the supplying unit with the developer, wherein the replenishing unit is provided with an opening on a developing chamber side of the transporting path facing the supplying unit, and includes a downstream side counter member, and wherein the downstream side counter member has a regulating surface with a gap.

20 Claims, 16 Drawing Sheets

DEVELOPING DEVICE, AND IMAGE FORMING APPARATUS USING THE SAME

CROSS-REFERENCE TO RELATED APPLICATIONS

This application is based on and claims priority under 35 USC 119 from Japanese Patent Application No. 2012-259181 filed Nov. 27, 2012.

BACKGROUND

Technical Field

The present invention relates to a developing device, and an image forming apparatus using the same.

SUMMARY

According to an aspect of the invention, there is provided a developing device including a transporting unit that rotates while being opposed to an image holding member, which circulates while holding an electrostatic latent image, and that transports a developer toward the image holding member so as to develop the electrostatic latent image on the image holding member, a supplying unit that has the developer adhered onto a circumferential surface thereof being rotated and that supplies the developer to the transporting unit in contact with the transporting unit, and a replenishing unit that includes a transporting path connected between a containing chamber which contains the developer and a supplying chamber in which the supplying unit is disposed, that keeps the developer, with which the supplying unit is replenished, remaining, and that replenishes the supplying unit with the developer, wherein the replenishing unit is provided with an opening on a developing chamber side of the transporting path facing the supplying unit, and includes a downstream side counter member which is opposed to the supplying unit on a downstream side of the supplying unit in a rotation direction thereof with the opening on the developing chamber side of the transporting path interposed therebetween, and wherein the downstream side counter member has a regulating surface, which is curved along the circumferential surface of the supplying unit, with a gap which regulates the developer to be adhered onto the supplying unit.

BRIEF DESCRIPTION OF THE DRAWINGS

Exemplary embodiments of the present invention will be described in detail based on the following figures, wherein.

DETAILED DESCRIPTION

Brief Overview of Exemplary Embodiment

Figure 1A:
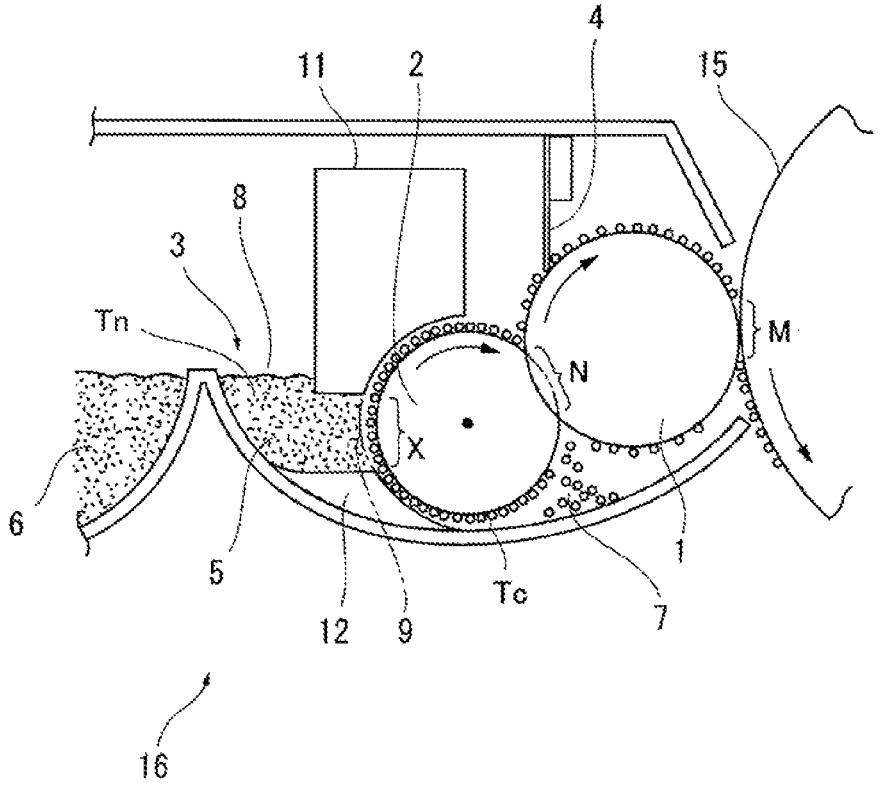
FIG. 1A is an explanatory diagram illustrating a brief overview of an exemplary embodiment of an image forming apparatus including a developing device according to the present invention.

FIG. 1A is an explanatory diagram illustrating a brief overview of an exemplary embodiment of an image forming apparatus including a developing device according to the present invention.

In the drawing, the image forming apparatus includes an image holding member 15 that circulates while holding an electrostatic latent image, and a developing device 16 that is disposed to be opposed to the image holding member 15 and develops the electrostatic latent image on the image holding member 15.

Figure 1B:
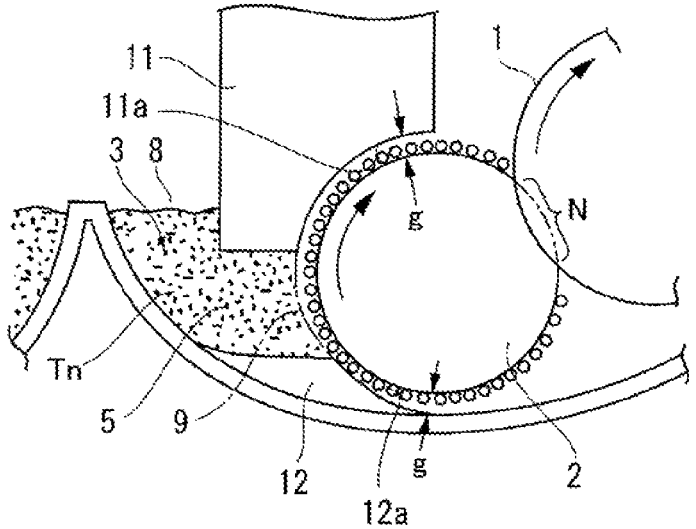
FIG. 1B is an explanatory diagram illustrating a principal part thereof.

In addition, as shown in FIGS. 1A and 1B, the developing device 16 used in the present exemplary embodiment includes: a toner holding member 1 as a transporting unit that is rotatably provided to be opposed to the image holding member 15, which circulates while holding the electrostatic latent image, and holds and transports a nonmagnetic single-component toner as a developer toward a development region M opposed to the image holding member 15 so as to develop the electrostatic latent image on the image holding member 15; a supplying member 2 as a supplying unit that has a rough surface, on which the toner may be captured, on a circumferential surface of an elastic member which is elastically deformable, and is rotatably provided in elastic contact with the toner holding member 1, so as to supply the toner from a contact region N, which comes into contact with the toner holding member 1, to the toner holding member 1; a toner replenishing unit 3 as a replenishing unit that faces a replenishment region X at the portion apart from the contact region N of the supplying member 2 with the toner holding member 1 so as to replenish a new toner Tn; and a regulating member 4 that is provided on the downstream side of the contact region N, which comes into contact with the supplying member 2, in the toner holding member 1 in the rotation direction and on the upstream side of the development region M of the toner holding member 1 so as to triboelectrically charge the toner held on the toner holding member 1 and regulate the amount of toner provided for the development. In the toner replenishing unit 3, a containing chamber 6, which contains the new toner Tn such that the toner may be replenished, is connected to a developing chamber 7, in which the supplying member 2 and the toner holding member 1 are disposed, through a toner transporting path 5, a developing chamber side opening 9 of the toner transporting path 5 is disposed to face the supplying member 2, a downstream side counter member 11 opposed to the supplying member 2 is disposed on the downstream side of the supplying member 2 in the rotation direction with the developing chamber side opening 9 of the toner transporting path 5 interposed therebetween. The downstream side counter member 11 has a regulating surface 11*a*, which is formed in a curved shape along the circumferential surface of the supplying member 2, with a gap g interposed therebetween, where the gap g is capable of regulating the toner layer to be captured on the supplying member 2.

In such a technical unit, any type of the toner holding member 1 may be used if it holds the toner and provides the toner to the development region M between itself and the image holding member 15.

Further, the supplying member 2 may rotate in a direction opposite to the toner holding member 1 at the portion opposed thereto, and may rotate in the same direction. Here, in the case where the members rotate in the same direction, in order to supply the toner from the supplying member 2 to the toner holding member 1, a difference in speed between both of them is necessary. Furthermore, the supplying member 2 may have a rough surface (unevenness) for capturing the toner on the circumferential surface thereof, and a typical example thereof is foam, but for example, an elastic rubber, on which concave portions such as grooves are formed on the circumferential surface thereof, may be used. Moreover, the foam may be either interconnected cell foam or independent cell foam, but the interconnected cell foam is preferable in view of softness and costs.

In addition, any type of the toner replenishing unit 3 may be used if it replenishes the new toner Tn in the predetermined replenishment region X on the supplying member 2.

Here, the replenishment region X determined by the toner replenishing unit 3 is set as a portion apart from the contact region N between the toner holding member 1 and the supplying member 2. The reason is to actively prevent the old and new toners from being mixed on the supplying member 2 when the new toner Tn is directly supplied to the contact region N between the toner holding member 1 and the supplying member 2 by the toner replenishing unit 3.

Further, the regulating member 4 triboelectrically charges the toner which is held on the toner holding member 1, and regulates the amount of toner to a predetermined amount. The regulating member 4 is typically a plate-like member that extends to be opposed to the toner holding member 1 in the rotation direction of the toner holding member 1 and comes into elastic contact therewith, but is not limited to this, and a rotating member or the like may be used. Since the toner captured on the supplying member 2 is triboelectrically charged by the regulating member 4, in a situation where the new toner Tn and the old toner Tc with different charging characteristics are mixed, the charge amounts of the old and new toners have a large variation, and the charge distribution thereof spreads. On this point, in a situation where most of the toner captured on the supplying member 2 is the old toner Tc, the charging characteristics thereof are substantially the same, and thus there is no possibility of the variation of the charge amounts and the spreading of the charge distribution.

Furthermore, any type of the toner replenishing unit 3 may be used if it connects the developing chamber 7 and the containing chamber 6 of the new toner Tn through the toner transporting path 5, and the shape of the toner transporting path 5 may be a linear shape, a bend shape, a curved shape, or the like. In addition, it is necessary for the developing chamber side opening 9 of the toner transporting path 5 be disposed to face the supplying member 2. If the opening is disposed not to face the supplying member 2, there is a concern about a situation where the new toner Tn and the old toner Tc are mixed in the developing chamber 7.

Furthermore, the downstream side counter member 11 has a regulating surface 11*a*, which is formed in a curved shape along the circumferential surface of the supplying member 2, with a gap g interposed therebetween, where the gap g is capable of regulating the toner layer to be captured on the supplying member 2. Thus, the new toner Tn is present at the portion facing the developing chamber side opening 9 of the toner transporting path 5. However, in a situation where the old toner Tc is captured on the circumferential surface of the supplying member 2, when the toner passes through the region corresponding to the developing chamber side opening 9 of the toner transporting path 5, the new toner Tn is partially adhered onto the surface of the old toner layer of the supplying member 2 and is transported. However, when the toner reaches the region corresponding to the downstream side counter member 11, the new toner Tn, which is adhered onto the surface of the old toner layer of the supplying member 2 by the regulating surface 11*a* of the downstream side counter member 11, is regulated when the toner passes in front of the downstream side counter member 11.

If the toner is provided to the development region M of the image holding member 15 so as to be developed, the amount of re-transported toner is reduced by the old toner Tc around the supplying member 2, and the portion of the circumferential surface of the supplying member 2, in which the re-transported toner is reduced, is recessed. When the recessed portion passes in front of the developing chamber side opening 9 of the toner transporting path 5, the new toner Tn is replenished in the region, in which the re-transported toner is reduced, on the circumferential surface of the supplying member 2, and passes the region corresponding to the downstream side counter member 11.

Next, a typical configuration or a preferable configuration of the developing device will be described.

First, in a preferable configuration of the developing device 16, the upstream side counter member 12, which is opposed to the supplying member 2, is disposed on the upstream side of the supplying member 2 in the rotation direction, with the developing chamber side opening 9 of the toner transporting path 5 interposed therebetween, and the upstream side counter member 12 has a regulating surface 12*a*, which is formed in a curved shape along the circumferential surface of the supplying member 2, with the gap g interposed therebetween, where the gap g is capable of regulating the toner layer to be captured on the supplying member 2. Here, the distance of the gap g is set to satisfy the maximum amount of consumed toner per unit time in the developing device 16.

In the present configuration, since the upstream side counter member 12 has the regulating surface 12*a* on the upstream side of the supplying member 2 in the rotation direction with the developing chamber side opening 9 of the toner transporting path 5 interposed therebetween, the new toner Tn within the toner transporting path 5 is effectively prevented from leaking from the upstream side of the supplying member 2 in the rotation direction into the developing chamber 7 side.

Further, in a preferable configuration of the toner transporting path 5, the developing chamber side opening 9 of the toner transporting path 5 is positioned below the containing chamber side opening 8 of the toner transporting path 5.

Here, "the developing chamber side opening 9 of the toner transporting path 5 is positioned below the containing chamber side opening 8" is a prerequisite for causing the new toner Tn to remain in the toner transporting path 5 by its own weight. In the present example, the remaining new toner Tn is pressed to the supplying member 2 by its own weight. Thus, the example is preferable in that the old toner Tc captured on the supplying member 2 is scattered at the portion facing the toner transporting path 5 and is unlikely to be mixed with the new toner Tn within the toner transporting path 5.

Furthermore, a preferable range of the gap g of the counter member (the downstream side counter member 11 or the upstream side counter member 12) is set to be not less than 0.5 mm and not more than 1 mm. Here, the upper limit represents a boundary value which is preferable to effectively prevent the new toner Tn from leaking into the developing chamber 7, and the lower limit represents a boundary value which is preferable to prevent the upstream side counter member 12 and the supplying member 2 from coming into contact on the basis of the adhesion tolerance.

Moreover, in a preferable configuration of an arrangement of the counter members (the downstream side counter member 11, and the upstream side counter member 12), the counter members have the regulating surfaces 11*a* and 12*a* with lengths which are equal to or greater than the width of the developing chamber side opening 9 of the toner transporting path 5 along the rotation direction of the supplying member 2. As described above, when the lengths of the regulating surface 11*a* and 12*a* determined by the counter member 11 and 12 are secured to be equal to or greater than the width of the developing chamber side opening 9 of the toner transporting path 5, the configuration is preferable in that the new toner Tn within the toner transporting path 5 is unlikely to leak into the developing chamber 7 through the gap g between the supplying member 2 and each of the counter members 11 and 12.

In addition, in a preferable configuration of the developing chamber side opening 9 of the toner transporting path 5, the opening is disposed to be closer to on the downstream side of the supplying member 2 in the rotation direction than the bottom position of the supplying member 2 and be closer to the upstream side of the supplying member 2 in the rotation direction than the top position of the supplying member 2.

Here, when the developing chamber side opening 9 of the toner transporting path 5 is closer to the upstream side of the supplying member 2 in the rotation direction than the bottom position of the supplying member 2, the old toner Tc, which is separated from the contact region N between the toner holding member 1 and the supplying member 2, tends to be directly mixed with the new toner Tn from the developing chamber side opening 9 of the toner transporting path 5. Further, when the developing chamber side opening 9 of the toner transporting path 5 is closer to the top position of the supplying member 2 than the downstream side of the supplying member 2 in the rotation direction, there is a concern that the new toner Tn, which is transported from the toner transporting path 5, tends to be mixed in the contact region N between the toner holding member 1 and the supplying member 2 by its own weight. An object of the configuration is to avoid these defects.

Further, in a preferable configuration of the image forming apparatus including such a type of the developing device 16, the control device (not shown in the drawing) capable of controlling the consumption of the toner is additionally provided.

Such a type of the control device includes, for example: a calculating section which calculates the amount of toner consumed in image forming performed a predetermined times; a determining section which determines whether or not the amount of toner calculated in the calculating section is greater than or equal to a predetermined threshold value; an ejecting section which ejects the toner within the developing device 16 toward the image holding member 15 by a predetermined amount if the amount of toner determined in the determining section is less than the threshold value; and a cleaning processing section that cleans the toner, which is ejected from the ejecting section, on the image holding member 15.

In the present configuration, considering that the toner tends to be deteriorated since the old toner Tc on the supplying member 2 is not consumed and remains when the amount of consumed toner is small, an object of the configuration is to stabilize the development quality by detecting the deteriorated toner in advance and removing the toner.

Here, in a typical configuration of the calculating section for the amount of consumed toner, it is possible to calculate the amount of consumed toner on the basis of image density. The number of times image is formed may be calculated by counting the number of output sheets of the recording material converted into the reference size, and may be calculated by counting the driving time of the developing device 16. Further, the threshold value provided for determination may be calculated as a limit value (lower limit tolerance), which does not cause, for example, development defects, in advance by the experiment and the like. Furthermore, in the toner ejecting section, under the condition where development defects is highly likely to occur, the toner captured on the supplying member 2 is regarded as the deteriorated toner. Accordingly, any type of the toner ejecting section may be used if it forcedly ejects the toner from the developing device 16, and ejects the toner typically in a way of forming an electrostatic latent image for ejecting the toner to the image holding member 15 and developing the image. In addition, the image, which is formed on the basis of the ejection operation, is not particularly limited, but may be a beta image, and may be a different image. Further, a different image may be used in accordance with the amount of consumed toner. However, it is necessary to eject a large amount of toner when the amount of consumed toner is small. Furthermore, in a general configuration of the cleaning processing section, a cleaning unit on the image holding member 15 side is used. However, the cleaning processing section is not limited to this, but may give an output onto a recording material, and a different cleaning component may be separately provided.

Hereinafter, on the basis of the exemplary embodiment shown in the accompanying drawings, the present invention will be described in detail.

Exemplary Embodiment 1

Overall Configuration of Image Forming Apparatus

Figure 2:
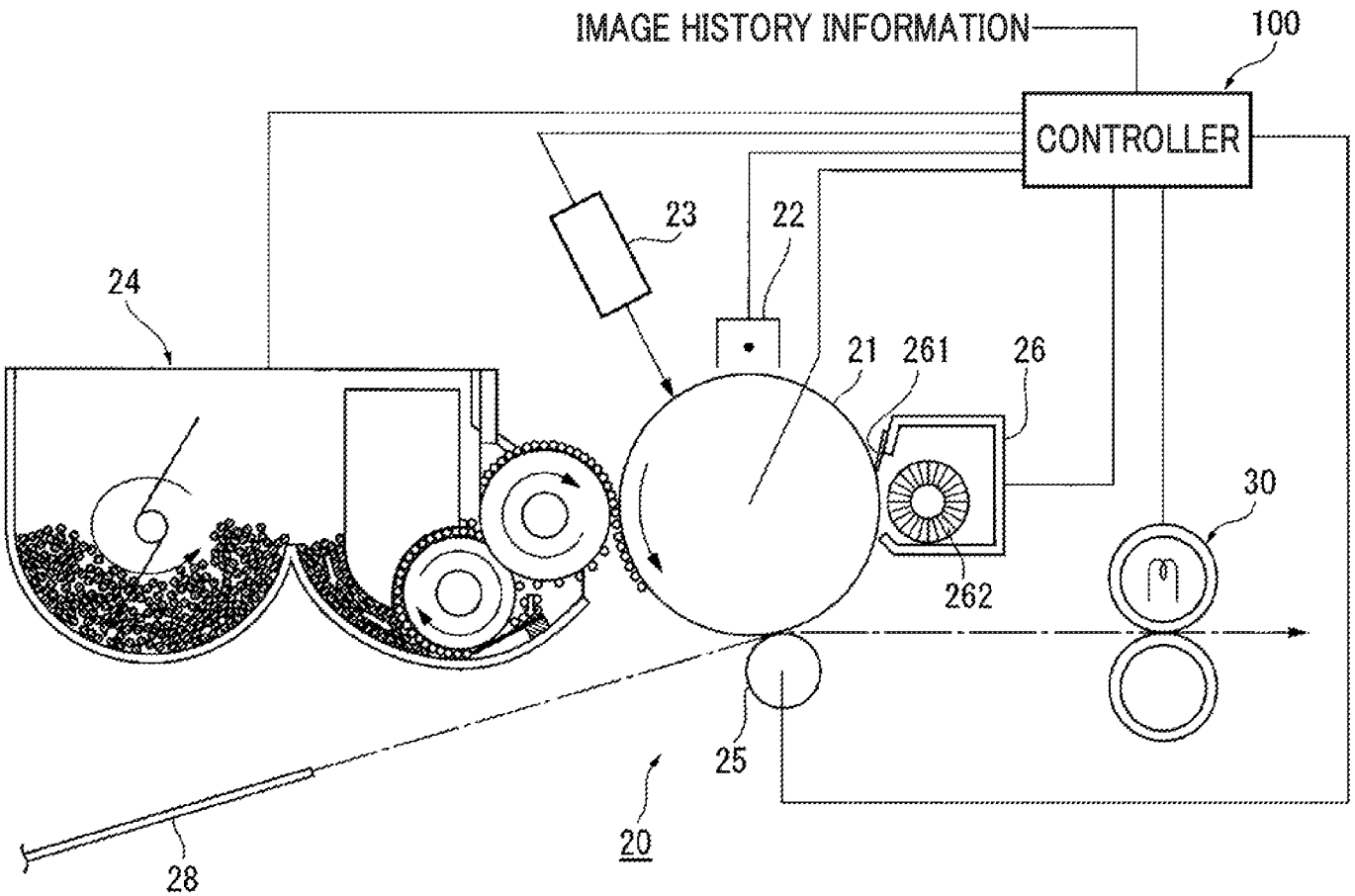
FIG. 2 is an explanatory diagram illustrating an overall configuration of an image forming apparatus according to Exemplary Embodiment 1.

FIG. 2 is an explanatory diagram illustrating an overall configuration of an image forming apparatus according to Exemplary Embodiment 1.

In the same drawing, the image forming apparatus 20 includes: a drum-like photoconductor 21 as an image holding member; a charging device 22 that charges the photoconductor 21; an exposure device 23 that writes the electrostatic latent image onto the photoconductor 21, which is electrically charged by the charging device 22, with light; a developing device 24 that visualizes the electrostatic latent image, which is written onto the photoconductor 21, in the developer (toner); a transfer device 25 that transfers the toner image, which is visualized in the developing device 24, onto a recording material 28 as a transfer medium; and a cleaning device 26 that cleans the remaining toner which is transferred by the transfer device 25 and remains on the photoconductor 21.

In addition, in the present example, the transfer image, which is transferred onto the recording material 28, is fixed by the fixing unit 30 and discharged. Further, the reference number 100 represents a control device that controls the components of the image forming apparatus 20. In addition, in the present example, the recording material 28 is exemplified as a transfer medium. However, the material is not limited to this, and may include an intermediate transfer body that temporarily holds the toner image before transferring the toner image onto the recording material 28.

Here, the photoconductor 21 is configured such that a photosensitive layer is formed on a drum-like metal frame body.

Further, the charging device 22 has, for example, a charging container. In the charging container, a discharging wire as a charging member is disposed, and the charging device 22 is not limited to this. For example, a roll-shaped charging member may be used.

Furthermore, a laser scanning device, an LED array, or the like is used as the exposure device 23.

Moreover, a developing device based on a single-component development system using the nonmagnetic toner is used as the developing device 24. In addition, detail of the developing device 24 will be described later.

Further, any type of the transfer device 25 may be used if it applies to the transfer electric field for electrostatically transferring the toner image on the photoconductor 21 to the recording material 28 side. For example, a roll-shaped transfer member to which the transfer voltage is applied is used, but the transfer device is not limited to this, and a transfer corotoron or the like using the discharging wire may be used.

Furthermore, a cleaning container, which is open toward the photoconductor 21 and contains the remaining toner, is provided as the cleaning device 26. A plate-like cleaning member 261 such as a blade or a scraper is disposed at the edge on the downstream side of the photoconductor 21 in the rotation direction in the opening of the cleaning container, and a brush-shaped or roll-shaped rotation cleaning member 262 is disposed on the upstream side of the plate-like cleaning member 261 in the rotation direction of the photoconductor 21. However the cleaning member is not limited to this, and any type may be used.

In addition, all or some of the photoconductor 21, the charging device 22, the developing device 24, and the cleaning device 26 may be assembled in advance as a process cartridge which is an image forming assembly, and may be detachably mounted on the housing section which is provided in advance in the image forming apparatus casing.

Basic Configuration of Developing Device

In the present example, as shown in FIGS. 2 to 5, the developing device 24 has a development container 40 that contains the nonmagnetic toner T and is open opposed to the photoconductor 21. A developing roller 41 is disposed at the portion of the development container 40 facing the opening, and a supplying roller 42 capable of supplying the nonmagnetic toner T within the development container 40 to the developing roller 41 is disposed on the rear surface of the developing roller 41. Further, a plate-like charging blade 45 is disposed on the downstream side of the portion of the developing roller 41, to which the toner is supplied by the supplying roller 42, in the toner transport direction. Furthermore, a toner replenishing mechanism 60, which is capable of replenishing the new nonmagnetic toner Tn to the supplying roller 42, is provided on the rear surface of the supplying roller 42.

In addition, one end of a sealing member (not shown in the drawing) formed of an elastic member is fixed on the lower edge of the opening of the development container 40, and the free end of the sealing member is disposed in elastic contact with the developing roller 41, thereby blocking the gap between the developing roller 41 and the development container 40.

Developing Roller and Supplying Roller

In the present example, the developing roller 41 rotates in the same direction as the photoconductor 21 at the portion opposed to the photoconductor 21, a roller main layer 41*b*, which has a predetermined volume resistivity and is made of resin or rubber, is formed around the metal shaft member 41*a*, and the surface of the roller main layer 41*b* has roughness so as to be able to transport the toner.

Further, the supplying roller 42 rotates in the direction opposite to the developing roller 41 at the portion opposed to the developing roller 41, and an elastic layer 42*b*, which has a predetermined volume resistivity and is elastically deformable, is formed around the metal shaft member 42*a*. The elastic layer 42*b* is constituted by foam such as urethane foam sponge rubber, and the surface is formed as a rough surface 42*c* (refer to FIG. 5) on which the toner may be sufficiently adhered.

In the present example, the elastic layer 42*b* of the supplying roller 42 is more sufficiently softened than the roller main layer 41*b* of the developing roller 41. Hence, the developing roller 41 and the supplying roller 42 are disposed such that the developing roller 41 digs into the elastic layer 42*b* of the supplying roller 42 by a predetermined amount of digging. With such arrangement, the contact region N (nip region) is formed between both of them. In the present example, in the contact region N between the developing roller 41 and the supplying roller 42, the supplying roller 42 rotates in the direction from the top toward the bottom, and the developing roller 41 rotates in the direction from the bottom toward the top.

Hence, the supplying roller 42 separates the transporting toner on the developing roller 41 from the contact region N between itself and the developing roller 41, and supplies the toner on the supplying roller 42 side to the developing roller 41. In addition, the developing roller 41 holds the nonmagnetic toner T which is supplied from the supplying roller 42, and transports the toner to the development region M opposed to the photoconductor 21, whereby the toner is provided for development in the development region M.

Charging Blade

The charging blade 45 is constituted by a plate made of metal such as bronze, one end thereof is fixed at the edge of the opening of the development container 40, and the blade extends to protrude in a direction opposite to the rotation direction of the developing roller 41, and is disposed to be pressed in contact with the surface of the developing roller 41 at a predetermined pressure. Therefore, the toner T, which is held on the developing roller 41, passes the pressurized contact portion between the charging blade 45 and the developing roller 41. Thereby, the toner is triboelectrically charged, and is regulated by a predetermined amount of transport which may be determined in advance. In addition, the charging blade 45 is fixed at the edge of the opening of the development container 40 with a bracket 46 interposed therebetween.

Development Container

The development container 40 has a developing chamber 51 in which the developing roller 41 and the supplying roller 42 are disposed, and has a containing chamber 52 that contains the new toner Tn which may be replenished in the developing chamber 51, at the portion adjacent to the developing chamber 51.

In the present example, a block-like partitioning member 53, which partitions the developing chamber 51 and the containing chamber 52, is provided in the development container 40 so as to be apart from the bottom wall of the development container 40. Further, the bottom wall of the development container 40 is integrally formed with double-barreled curved portions 40*a* and 40*b* which are curved to protrude downward, and a chevron-shaped division portion 54 is formed at the portion of the boundary between the curved portions 40*a* and 40*b*.

Toner Replenishing Mechanism

In the present example, in the toner replenishing mechanism 60, the new toner Tn is contained in the containing chamber 52 of the development container 40, the containing chamber 52 and the developing chamber 51 are connected through a toner transporting path 61, and an agitator 62 as a stirring transporting member, by which the new toner Tn is transported toward the developing chamber 51 through the toner transporting path 61 while being stirred, is disposed in the containing chamber 52.

In addition, the curved portion 40*b* corresponding to the containing chamber 52 in the bottom wall of the development container 40 is formed to be curved along the curvature of the locus of the rotation free end of the agitator 62.

Toner Transporting Path

In the present example, the toner transporting path 61 is formed between the partitioning member 53 and the curved portion 40*b* as a part of the bottom wall of the development container 40.

Figure 5:
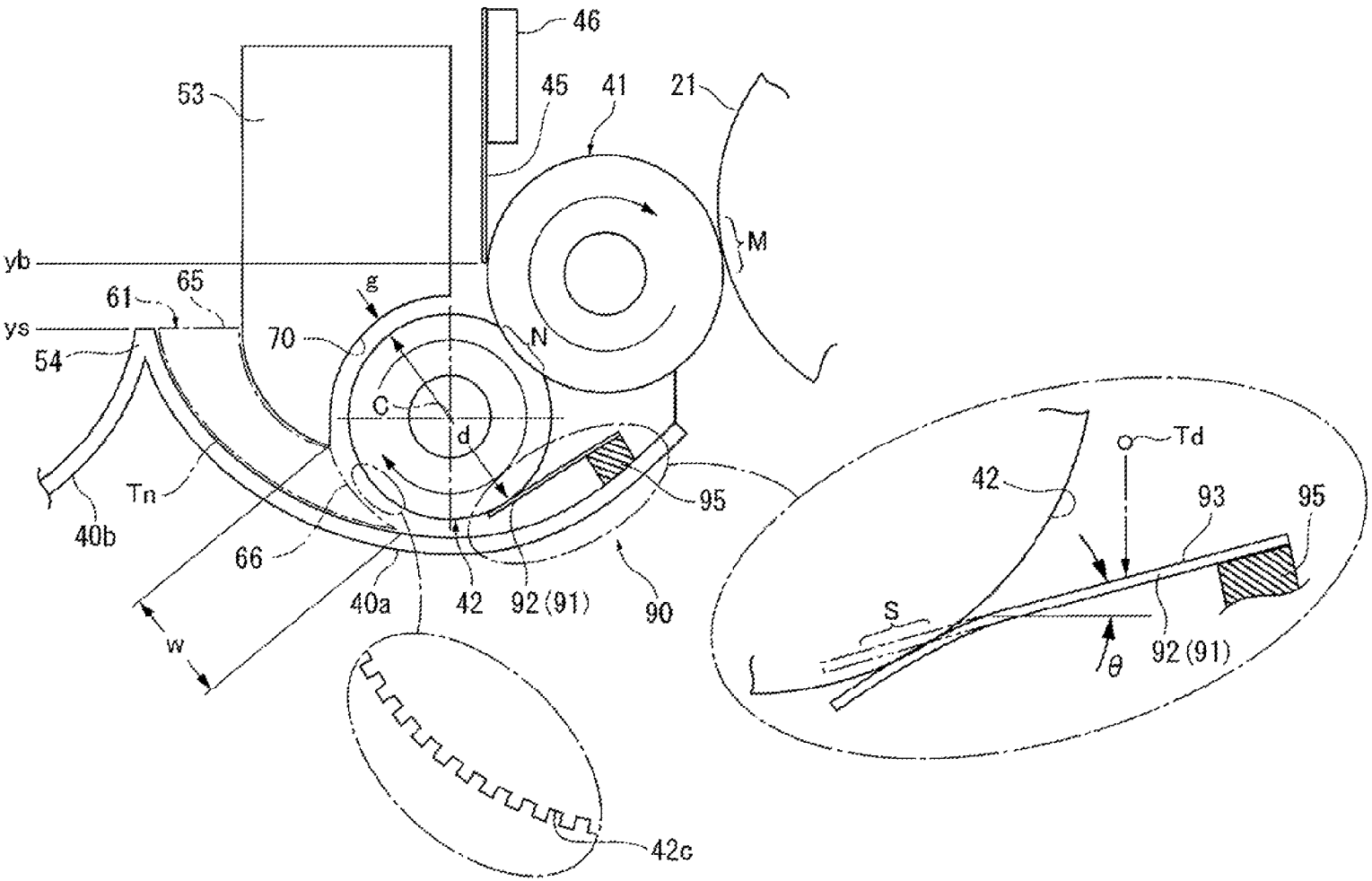
FIG. 5 is an explanatory diagram illustrating a detail of the principal part of the developing device shown in FIG. 4.

Here, in the toner transporting path 61, as shown in FIG. 5, a containing chamber side opening 65 is positioned above a developing chamber side opening 66, and is formed in a shape which is curved along the curved portion 40*a* from the containing chamber 52 toward the developing chamber 51.

Further, the developing chamber side opening 66 of the toner transporting path 61 is disposed to face the supplying roller 42, whereby the replenishment region X for replenishing the new toner Tn to the developing chamber 51 is formed.

In particular, in the present example, the developing chamber side opening 66 of the toner transporting path 61 is formed at the portion (in the present example, the portion separated by a half of the circumference) apart from the contact region N between the developing roller 41 and the supplying roller 42, and is provided below the center position C of the supplying roller 42, and the width w of the developing chamber side opening 66 along the rotation direction of the supplying roller 42 is set to be smaller than the outer diameter d of the supplying roller 42 on the projection plane viewed from the supplying roller 42.

In addition, in the present example, the new toner Tn within the containing chamber 52 is transported to the toner transporting path 61 by the agitator 62. Thus, as indicated by the chain line of FIG. 5, the toner transporting path 61 is filled with the new toner Tn remaining by its own weight, and the toner presses the supplying roller 42 through the developing chamber side opening 66.

Division Portion and Partitioning Member

Further, the containing chamber side opening 65 of the toner transporting path 61 is provided at the position ys corresponding to the apex of the chevron-shaped division portion 54 which is integrally formed on a part of the bottom wall of the development container 40. However, it is preferable that the opening be set at least below the contact position yb with the developing roller 41 in the charging blade 45. When setting is made on the basis of the dimensions mentioned above, even if the new toner Tn remains and is filled in the toner transporting path 61, there is no concern that the toner within the developing chamber 51 is pushed up to the contact position yb with the developing roller 41 in the charging blade 45 by application of the pressure caused by the toner remaining portion of the new toner Tn, and it is possible to effectively prevent the pressure contact state of the charging blade 45 to the developing roller 41 from being changed in accordance with an increase in the toner filled at the position of the charging blade 45 of the developing chamber 51.

Furthermore, in the present example, a regulating surface 70, which is opposed to the supplying roller 42 and has a curved shape along the circumferential surface of the supplying roller 42 with a gap g interposed therebetween, is formed at the portion of the partitioning member 53 adjacent to the developing chamber side opening 66 of the toner transporting path 61. Here, any value of the gap g may be set if the toner layer to be captured on the supplying roller 42 may be regulated by the gap, but in the present example, the gap is set in a range of 0.5 mm to 1.0 mm. In this case, the lower limit (0.5 mm) is set to a dimension which is necessary to keep the partitioning member 53 from not being in contact with the supplying roller 42 in view of the adhesion tolerance when the partitioning member 53 is mounted in the development container 40. In addition, the upper limit (1.0 mm) is set to a dimension which is necessary to regulate the toner layer to be captured on the supplying roller 42.

Power Supply for Generating Electric Field

In the present example, a developing power source 81, which is for generating an electric field for development between the developing roller 41 and the photoconductor 21, is provided in the developing roller 41. Further, a supplying power source 82, which is for generating an electric field for supplying the nonmagnetic toner T to the developing roller 41, is provided in the supplying roller 42.

Here, the developing power source 81 is configured to apply a developing voltage, in which the AC component is superposed upon the predetermined DC component, to the developing roller 41. Further, the supplying power source 82 has the DC component of the predetermined electric potential difference (also including '0') relative to the DC component of the developing power source 81, and may be configured to apply a supplying voltage in which the AC component of the developing power source 81 and the AC component having the same cycle are superposed upon the DC component.

However, even though the electric field for supply is not applied between the developing roller 41 and the supplying roller 42, when the supplying capability of the toner in the contact region N between both of them is secured, by employing a system that uses the developing power source 81 as the supplying power source 82, the electric potential difference between both of them may be set to approximately 0.

Adhesion Mechanism

In particular, in the present exemplary embodiment, an adhesion mechanism 90 is provided below the contact region N between the developing roller 41 and the supplying roller 42 in the developing chamber 51 in the development container 40, and is configured to adhere the toner, which is separated from the developing roller 41 and the supplying roller 42, onto the supplying roller 42.

As shown in FIG. 5, the adhesion mechanism 90 according to the present example has a guiding member 91 that receives the separated toner Td, which is separated when passing through the contact region N, and guides the separated toner Td, which is received, toward the supplying roller 42. The mechanism moves the separated toner Td, which is received in the guiding member 91, toward the supplying roller 42 by pressing a part of the guiding member 91 in contact with the circumferential surface of the supplying roller 42, and adheres the toner onto the circumferential surface of the supplying roller 42.

In the present example, the guiding member 91 is formed of an elastic sheet 92 which is elastically deformable, one end of the elastic sheet 92 is fixed onto an adhering target member 95 which is provided on a part of the bottom wall of the development container 40, and the elastic sheet 92 is inclined at an angle θ to the lateral direction such that the pressure contact portion S between itself and the supplying roller 42 is positioned below the receiving portion for the separated toner Td in the elastic sheet 92.

Examples of such a type of the elastic sheet 92 include a thermoplastic polyurethane sheet, a polyimide sheet, a polyester sheet, a PET sheet, and the like. Further, regarding the inclination angle θ of the elastic sheet 92, the lower limit is set to a value (for example 100) which is necessary to roll the separated toner Td. In contrast, if the inclination angle θ is excessively large, it is conceivable that the volume of the portion receiving the separated toner Td is reduced. Therefore, the upper limit is set to a range (for example 45°) which does not cause separation defects from the supplying roller 42 due to an increase in pressure of the toner at the receiving portion.

In particular, in the present example, it is preferable that the surface of the elastic sheet 92 (corresponding to the surface of the side on which the separated toner Td is received) has a smoothed surface 93 by which the separated toner Td may be rolled toward the supplying roller 42. It suffices that the smoothed surface 93 described herein satisfies for example a relationship of arithmetic mean roughness Rz represented by $Rz \leq 0.6$ μm.

Further, in the present example, the pressure contact portion S of the elastic sheet 92 is the vicinity of the leading end of the elastic sheet 92, and the contact force of the elastic sheet 92 applied to the supplying roller 42 is set to be smaller than the contact force in the contact region N between the developing roller 41 and the supplying roller 42. Specifically, regarding the straightened state in which the elastic sheet 92 is not elastically deformed, when the amount of elastic deformation at the pressure contact with the supplying roller 42 is defined by an amount of digging, the contact force is calculated on the basis of the elastic coefficient of the elastic sheet 92 and the amount of digging. Thereby, the contact force of the elastic sheet 92 may be appropriately set.

Furthermore, in the present example, the pressure contact portion S of the elastic sheet 92 is displaced from the lowermost portion of the supplying roller 42 toward the contact region N. For this reason, at the pressure contact portion S of the elastic sheet 92, the contact force is gradually increased toward the leading end side of the elastic sheet 92.

Basic Operation of Developing Device

Figure 3:
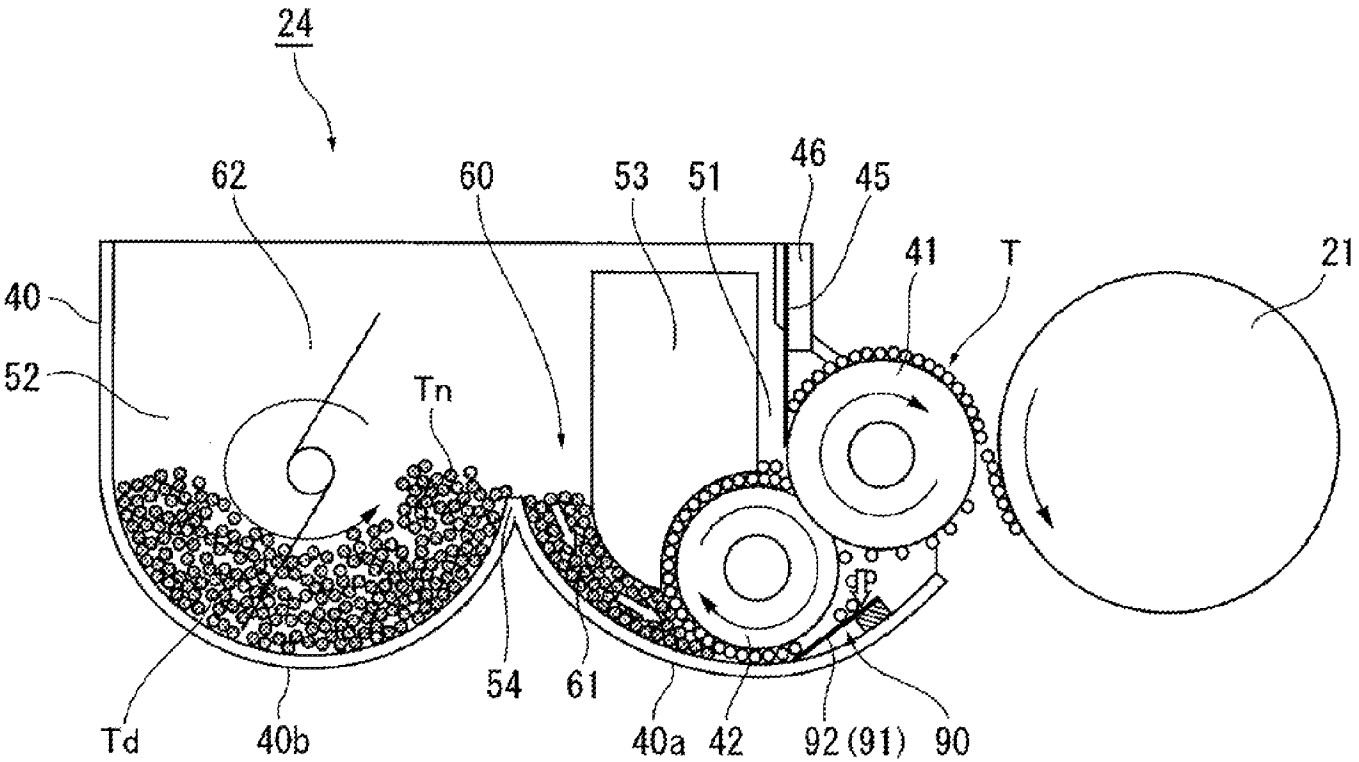
FIG. 3 is an explanatory diagram illustrating a developing device used in Exemplary Embodiment 1.
Figure 4:
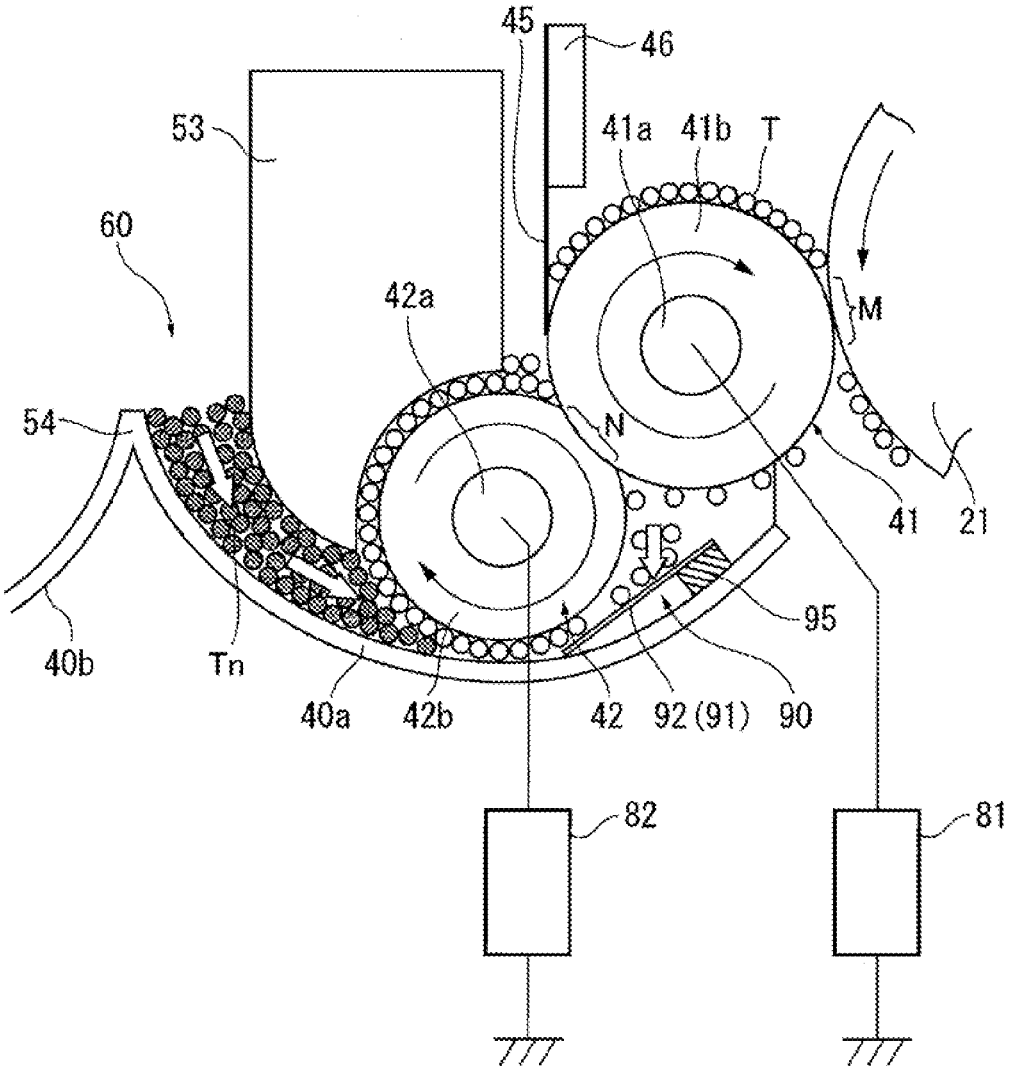
FIG. 4 is an explanatory diagram illustrating a principal part of the developing device shown in FIG. 3.

In the developing device 24 according to the present exemplary embodiment, as shown in FIG. 3, the supplying roller 42 rotates with the toner T captured, and transports the toner up to the contact region N between itself and the developing roller 41.

In the present example, the developing roller 41 and the supplying roller 42 move in directions opposite to each other in the contact region N. Hence, when the toner T captured on the supplying roller 42 passes through the contact region N, a part of the toner T is supplied to the developing roller 41, and the remaining part thereof is captured and remains on the supplying roller 42 or is separated and falls downward.

At this time, the toner T supplied to the developing roller 41 passes the charging blade 45 in accordance with rotation of the developing roller 41, is triboelectrically charged and regulated to the predetermined amount when passing the charging blade 45, is thereafter transported to the development region M between the developing roller 41 and the photoconductor 21. Thereby, the toner T is provided for development of the electrostatic latent image which is formed on the photoconductor 21.

Figure 6A:
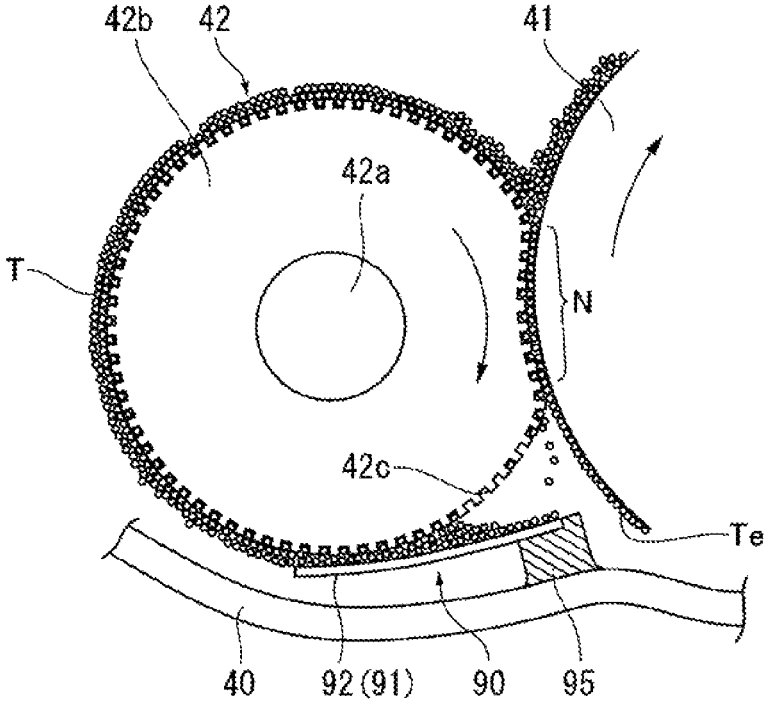
FIG. 6A is an explanatory diagram illustrating a behavior of the toner around a region of contact between a supplying roller and a developing roller.

Then, the unused remaining toner Te, which passes through the development region M of the developing roller 41, is transported up to the contact region N between the developing roller 41 and the supplying roller 42 by rotation of the developing roller 41, and most of the unused remaining toner Te is scraped off and separated in the contact region N (refer to FIG. 6A).

Further, the separated toner Td (refer to FIG. 6B), which is separated from the contact region N between the developing roller 41 and the supplying roller 42, is adhered onto the supplying roller 42 through the adhesion mechanism 90, and is transported again by rotation of the supplying roller 42 in a state where the separated toner Td is captured on the supplying roller 42 together with the remaining toner Ta (refer to FIG. 6B) which remains thereon.

Furthermore, when the toner captured on the circumferential surface of the supplying roller 42 is insufficient, the toner replenishing mechanism 60 appropriately replenishes the new toner Tn (refer to FIG. 7) on the circumferential surface of the supplying roller 42.

In such a manner, a series of the development operations is performed by the developing device 24.

Behavior of Toner Due to Adhesion Mechanism

In such a process of the development operations of the developing device 24, the behavior of the toner due to the adhesion mechanism 90 is as follows.

As shown in FIG. 6A, in the contact region N between the developing roller 41 and the supplying roller 42, the supplying roller 42 has the elastic layer 42*b* made of for example foam. Hence, the supplying roller 42 is recessed in a shape along the surface of the developing roller 41, and is recovered to its original state, in which the roller is not elastically deformed, after passing the contact region N. Hence, the linear speed of the circumferential surface of the supplying roller 42 increases in accordance with the recovery deformation after passage of the contact region N, the repelling force is caused by the recovery of the elastic layer 42*b*, and a part of the toner T captured on the rough surface 42*c* of the circumferential surface of the supplying roller 42 is separated by the repelling force.

In contrast, the unused remaining toner Te, which is not provided for development in the development region M of the developing roller 41, is transported to the contact region N by rotation of the developing roller 41, but the unused remaining toner Te, which is held on the developing roller 41, is scraped off and separated at the portion of the contact region N which is positioned on the upstream side (the downstream side in the rotation direction of the supplying roller 42) in the rotation direction of the developing roller 41.

Figure 6B:
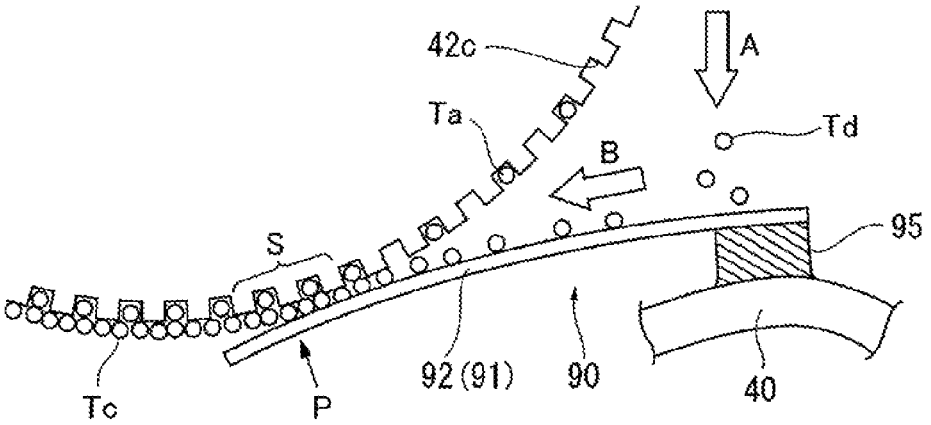
FIG. 6B is an explanatory diagram illustrating a behavior of the separated toner.

In such a manner, the separated toner Td, which is separated in the contact region N, falls downward as indicated by the arrow A of FIG. 6B, but is received and accumulated on the elastic sheet 92 as the guiding member 91 which is an element of the adhesion mechanism 90.

In this state, the elastic sheet 92 has a smoothed surface 93, and is inclined more obliquely downward at the pressure contact portion S coming into contact with the supplying roller 42 than the receiving portion for the separated toner Td. Thus, the separated toner Td, which is received on the elastic sheet 92, rolls along the inclined smoothed surface 93 of the elastic sheet 92, and moves toward the pressure contact portion S coming into contact with the supplying roller 42 as indicated by the arrow B of FIG. 6B.

In addition, the contact force P at the pressure contact portion S of the elastic sheet 92 gradually increases as it gets closer to the leading end of the elastic sheet 92 in accordance with the curvature of the circumferential surface of the supplying roller 42. Thus, the separated toner Td, which moves along the surface of the elastic sheet 92, is gradually pressed until reaching the pressure contact portion S of the elastic sheet 92, is triboelectrically charged between the elastic sheet 92 and the supplying roller 42, and is captured on the rough surface 42*c* of the circumferential surface of the supplying roller 42 together with the remaining toner Ta which remains thereon.

At this time, the contact force P of the elastic sheet 92 is distributed to be substantially equivalent throughout the pressure contact portion S along the axis direction of the supplying roller 42. Thus, the amount of transported toner on the circumferential surface of the supplying roller 42 is stably determined by the elastic sheet 92, and is averaged in the axis direction. Hence, at the supplying roller 42, in addition to the remaining toner Ta, the separated toner Td is tightly pressed with the contact force P by the elastic sheet 92, and is adhered and attached onto the circumferential surface of the supplying roller 42 by the image force of the toner. As a result, when passing the pressure contact portion S of the elastic sheet 92, the old toner Tc, which includes the remaining toner Ta and the separated toner Td, is captured on the circumferential surface of the supplying roller 42, and is transported again by rotation of the supplying roller 42.

As described above, since the separated toner Td is mostly adhered onto the circumferential surface of the supplying roller 42, the separated toner Td is prevented from being accumulated in the developing chamber 51 which is positioned below the contact region N.

Behavior of Toner due to Toner Replenishing Mechanism

Behavior of New Toner and Old Toner in Replenishment Region

Figure 7A:
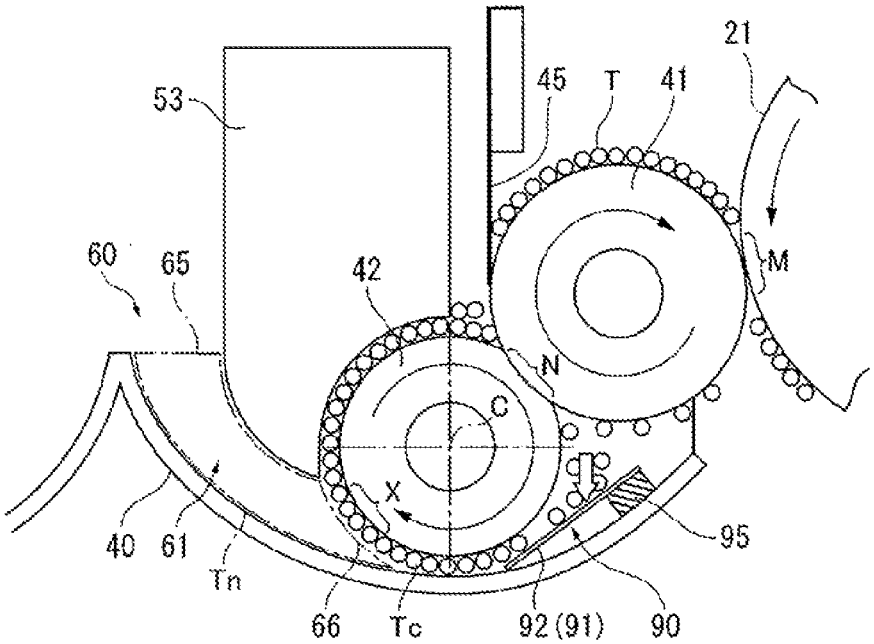
FIG. 7A is an explanatory diagram illustrating a behavior of the toner around a replenishment region of a new toner.

In such a manner, the supplying roller 42 does not transport the new toner Tn but transports the old toner Tc again to the replenishment region X of the toner replenishing mechanism 60 as shown in FIG. 7A.

In the present example, the toner replenishing mechanism 60 has a curved toner transporting path 61 which connects the containing chamber 52 and the developing chamber 51, the developing chamber side opening 66 of the toner transporting path 61 is disposed to face the supplying roller 42, and the developing chamber side opening 66 is disposed below the containing chamber side opening 65 of the toner transporting path 61.

Hence, a substantially constant amount of the new toner Tn remains and is filled in the toner transporting path 61, the pressure caused by the own weight of the toner remaining portion of the new toner Tn (the portion indicated by the chain line of FIG. 7A) is applied to the developing chamber side opening 66, the interface is formed between the new toner Tn and the toner within the developing chamber 51 by the toner remaining portion of the new toner Tn.

In addition, the new toner Tn, which is contained in the containing chamber 52, is transported toward the toner transporting path 61 by the agitator 62, but the new toner Tn remains and is filled in advance in the toner transporting path 61, and thus the fill amount of the new toner Tn, which remains in the toner transporting path 61, is scarcely changed.

Further, in the present example, the developing chamber side opening 66 of the toner transporting path 61 is formed below the center position C of the supplying roller 42, and the toner transporting path 61 is formed in a curved shape, and extends slightly obliquely downward in the lateral direction at the portion close to the developing chamber side opening 66.

In contrast, the layer of the old toner Tc, which is captured on the supplying roller 42, is formed around the supplying roller 42, and is moved in front of the developing chamber side opening 66 of the toner transporting path 61 by rotation of the supplying roller 42.

Then, at the portion facing the developing chamber side opening 66, the supplying roller 42 rotates in a direction in which it approaches the toner transporting path 61 from the lower side toward the upper side. Hence, the direction of the pressing force of the new toner Tn from the developing chamber side opening 66 of the toner transporting path 61 is set to be opposite to the rotation direction of the supplying roller 42, and thus the old toner Tc, which is transported again by the supplying roller 42, is transported again in a state where the toner is smoothed and adhered by the adhesion mechanism 90. Therefore, in the developing chamber side opening 66, the old toner Tc on the supplying roller 42 moves in a state where the old and new toners are prevented from being mixed along the interface formed by the toner remaining portion of the new toner Tn in the toner transporting path 61.

On this point, in the present exemplary embodiment, if the developing chamber side opening 66 of the toner transporting path 61 is formed up to the region above the center position C of the supplying roller 42, in the upper region of the center position C of the supplying roller 42, the supplying roller 42 rotates in a direction in which it is separated from the toner transporting path 61. Hence, the new toner Tn positioned on the interface of the toner remaining portion of the new toner Tn tends to be drawn by rotation of the supplying roller 42, and thus there is a possibility that the new toner Tn tends to leak toward the supplying roller 42. For this reason, the present exemplary embodiment is preferable.

In addition, also when the rotation direction of the supplying roller 42 is the backward direction (the direction of rotation from the top to the bottom at the portion facing the developing chamber side opening 66), the new toner Tn positioned on the interface of the toner remaining portion of the new toner Tn is drawn by rotation of the supplying roller 42, and thus there is a concern that the new toner Tn tends to leak toward the supplying roller 42. For this reason, the present exemplary embodiment is preferable.

Capture State I of Old Toner Captured on Supplying Roller (Sufficiently Captured)

Figure 7B:
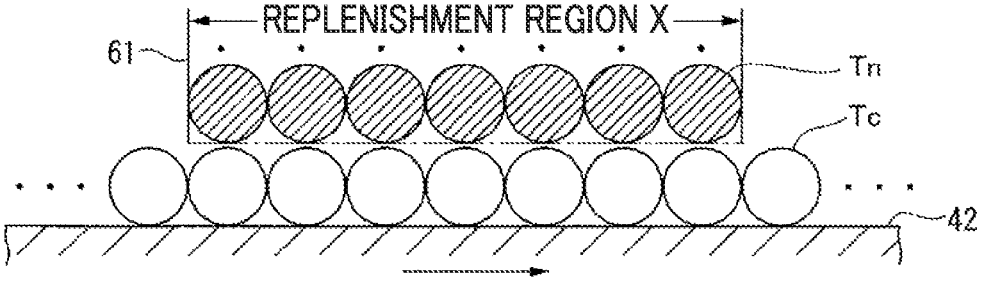
FIG. 7B is an explanatory diagram illustrating a behavior of the toner around the replenishment region of the new toner when a re-transported toner (old toner) is sufficiently captured on the supplying roller.

In such a state, as shown in FIG. 7B, when the old toner Tc which is the re-transported toner is sufficiently captured on the supplying roller 42, there is no extra toner capture space on the circumferential surface of the supplying roller 42. Thus, the new toner Tn, which remains in the toner transporting path 61, is unlikely to be captured on the circumferential surface of the supplying roller 42.

Further, the new toner Tn, which remains in the toner transporting path 61, presses the circumferential surface of the supplying roller 42. Therefore, the old toner Tc, which is captured on the supplying roller 42, may be prevented from flowing by the interface of the new toner Tn which remains in the toner transporting path 61. Thus, there is less concern that the old toner Tc leaks into and gets mixed with the new toner Tn within the toner transporting path 61.

Capture State II of Old Toner Captured on Supplying Roller (Insufficiently Captured)

Figure 7C:
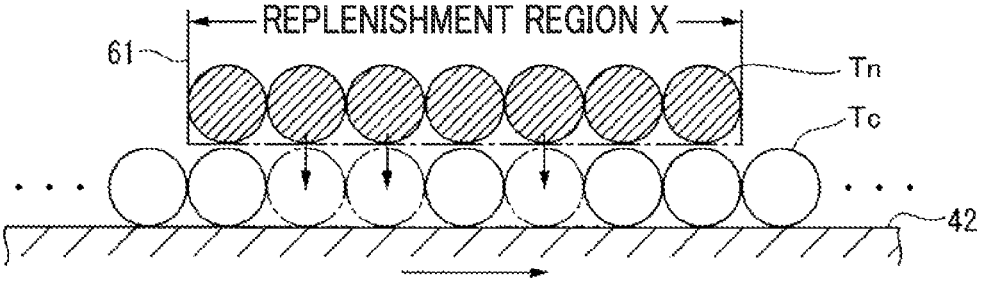
FIG. 7C is an explanatory diagram illustrating a behavior of the toner around the replenishment region of the new toner when the re-transported toner (old toner) is insufficiently captured on the supplying roller.

In contrast, as shown in FIG. 7C, when the old toner Tc as a re-transported toner captured on the supplying roller 42 is insufficient, the new toner Tn, which remains in the toner transporting path 61, presses the circumferential surface of the supplying roller 42 by its own weight. Hence, the new toner Tn is replenished at the location, at which the old toner Tc is not captured, on the supplying roller 42.

As described above, the new toner Tn is not replenished when the old toner Tc is sufficiently captured on the supplying roller 42, and the new toner Tn is replenished when the old toner Tc is insufficient. Thus, the old toner Tc and the new toner Tn are unnecessarily mixed on the circumferential surface of the supplying roller 42, and the old toner Tc is preferentially consumed.

Regulation of Amount of Toner Captured on Supplying Roller

Further, in the present exemplary embodiment, there is a concern that the toner around the old toner Tc captured on the circumferential surface of the supplying roller 42 follows the old toner Tc due to viscosity or the like and is moved in accordance with the rotation of the supplying roller 42.

However, in the present exemplary embodiment, the regulating surface 70, which has a curved shape along the circumferential surface of the supplying roller 42 with a predetermined gap g, is formed on the partitioning member 53 adjacent to the developing chamber side opening 66 of the toner transporting path 61. Thus, for example, even if the extra toner other than the toner captured around the supplying roller 42 follows and moves at the portion facing the bottom wall of the development container 40 or the developing chamber side opening 66 of the toner transporting path 61, when the extra toner passes the regulating surface 70 of the partitioning member 53, the extra amount of the toner captured on the circumferential surface of the supplying roller 42 is scraped off, and the amount of toner captured on the supplying roller 42 is regulated to a necessary amount.

As described above, by restricting the volume of toner occupied within the developing chamber 51, the amount of toner captured on the supplying roller 42 is regulated. Therefore, even when the space in which the stressed old toner Tc is spread and accumulated in the developing chamber 51 is restricted and the new toner Tn is supplied, charging distribution of the toner caused by mixture of the old and new toners is unlikely to be broadened.

In addition, as shown in FIG. 7A, the extra amount of the toner transported from the developing roller 41 is scraped off when passing the charging blade 45, and the scraped-off toner remains in the contact region of the charging blade 45. Thus, the space, which does not inhibit the above-mentioned toner from remaining behind the contact region of the charging blade 45, is necessary. However, the extra toner is prevented from being transported to the back side region of the contact region of the charging blade 45 by the regulating surface 70 of the partitioning member 53. Hence, there is no concern about accumulation of the extra toner in the back side region of the contact region of the charging blade 45.

Comparative Embodiment 1

Next, in order to evaluate the performance of the developing device according to Exemplary Embodiment 1, performance of an exemplary developing device according to Comparative Embodiment 1 will be described.

Figure 8:
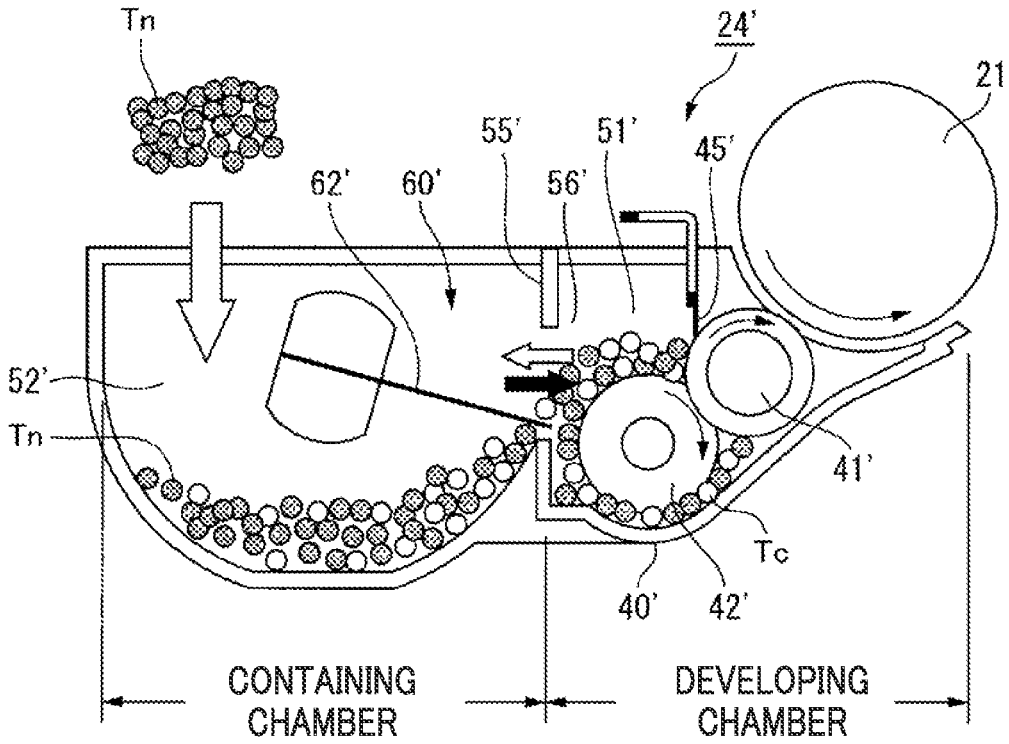
FIG. 8 is an explanatory diagram illustrating an example of a developing device according to Comparative Embodiment 1.

FIG. 8 shows the developing device according to Comparative Embodiment 1.

In the drawing, in a developing device 24', a division wall 55' is provided in a development container 40', a developing chamber 51' and a containing chamber 52' of the new toner Tn are divided, a toner transporting hole 56' is provided on a part of the division wall 55', a developing roller 41', a supplying roller 42', and a charging blade 45' are disposed in the developing chamber 51', and an agitator 62' as a toner replenishing mechanism 60' is disposed in the containing chamber 52'. In contrast, the developing device 24' does not employ 'the partitioning member 53 having the regulating surface 70', 'the new-toner-remaining-type toner transporting path 61', and 'the adhesion mechanism 90' which are employed in the developing device 24 according to Exemplary Embodiment 1.

In the present comparative embodiment, the following effects are provided.

That is, when the toner replenishing operation is started by the agitator 62', the new toner Tn within the containing chamber 52' is replenished from the toner transporting hole 56' into the developing chamber 51', the amount of toner within the developing chamber 51' increases, and exceeds the height of the toner transporting hole 56', and then the old toner Tc reversely flows from the developing chamber 51' into the containing chamber 52'.

Further, when the space of the developing chamber 51' around the supplying roller 42' is large, the separated toner, which is separated from the contact region N' between the developing roller 41' and the supplying roller 42', is gradually accumulated in the developing chamber 51', and the toner in a dead space, to which the transporting ability of the supplying roller 42' is not applied, is not consumed and is subjected to frictional stress from the supplying roller 42', and thereafter becomes a dead toner which is immovable.

In the developing device 24' according to Comparative Embodiment 1, in order to cope with the change in the amount of transported toner caused by the supplying roller 42', a sufficient space is secured around the supplying roller 42', but the stressed old toner Tc is spread and accumulated in the dead space. In this state, when the new toner Tn is input, the old and new toners are mixed around the old toner Tc which is spread and accumulated in the above-mentioned dead space.

Furthermore, when the new toner Tn and the old toner Tc are mixed in the developing chamber 51', external additives of the old toner Tc are exfoliated or the external additives are embedded in the toner particle basis, and thus there is a big difference in the coating level compared with the new toner Tn. Hence, when both of them are mixed, both of them are mutually electrically charged by the charging blade 45', and thus there is a big difference in the charging distribution between the new toner Tn and the old toner Tc. For this reason, some of the toner tends to be erroneously charged, and the phenomenon that the erroneously charged toner is unnecessarily scattered on the background of the recording material and the like tends to occur.

As described above, in the present comparative embodiment, it is difficult to prevent the old and new toners from being unnecessarily mixed on the supplying roller 42'. Conversely, in Exemplary Embodiment 1, by employing the new-toner-remaining-type toner replenishing mechanism 60 or the adhesion mechanism 90, it is possible to solve the problem of the developing device according to Comparative Embodiment 1.

Toner Ejection Control

In the present exemplary embodiment, the control device 100 performs the toner ejection control to forcedly eject the toner within the developing device 24 when the amount of consumed toner is smaller than a prescribed amount which is determined in advance.

In the configuration (refer to FIG. 3) of the developing device 24 of the present example, when the image output is small and the amount of consumed toner is excessively small, the toner on the supplying roller 42 or the unused remaining toner on the developing roller 41 repeatedly passes through the contact region N between the developing roller 41 and the supplying roller 42, a part of toner, which is separated, is adhered again onto the supplying roller 42 and transported again through the adhesion mechanism 90. Therefore, the old toner other than the new toner is likely to be circulated on the developing roller 41 and/or the supplying roller 42 in a state where the old toner is not consumed. In such a state, the extra stress is applied to the toner, and thus, for example, the external additives of the toner may be embedded in the toner, or the external additives may be separated from the toner. Hence, the charging characteristics of the toner are highly likely to be changed, or the fluidity of the toner is highly likely to be changed. When such a change in characteristics occurs in the toner, there is a concern that background fog occurs as the charge amount of the toner decreases, or image disarray (for example streaky image disarray) occurs due to fixing of the toner onto the charging blade 45 as the fluidity of the toner decreases.

Figure 9:
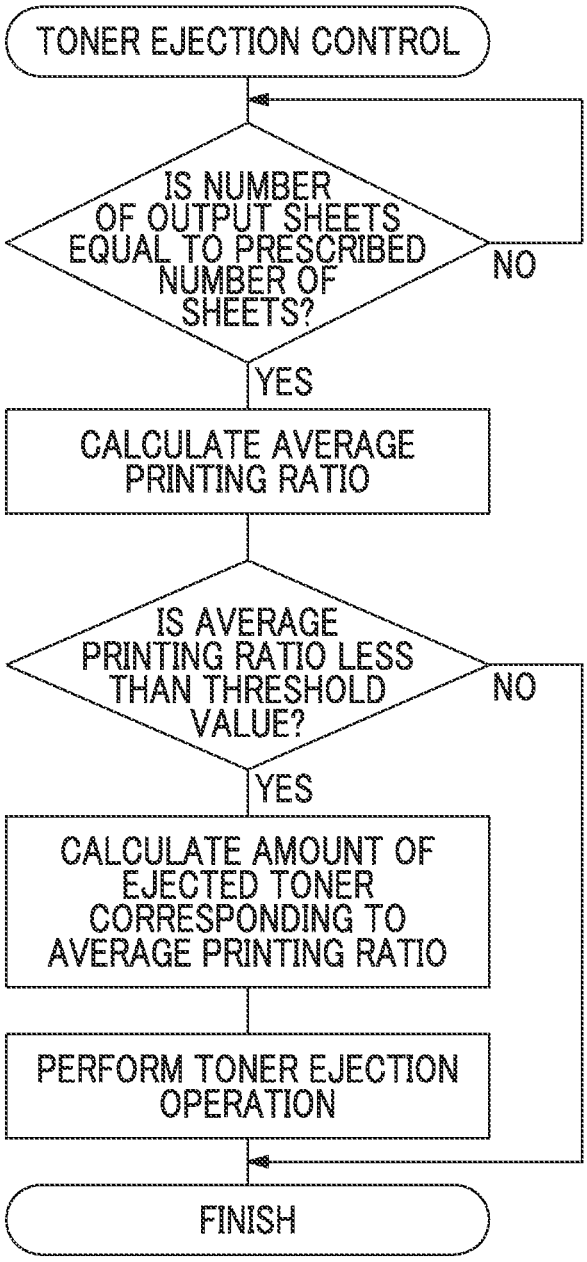
FIG. 9 is a flowchart illustrating a toner ejection control process employed in the present exemplary embodiment.

Accordingly, in the present exemplary embodiment, the toner ejection control shown in FIG. 9 is performed.

In order to perform the toner ejection control, as shown in FIG. 9, first, it is determined whether or not the number of output sheets reaches a prescribed number of sheets which is set to, for example, 500 in advance. The determination is continuously performed until the prescribed number of sheets is reached. If it is determined that the prescribed number of sheets is reached, from the image information hitherto obtained, the total number of dot counts (the sum of the total number of dots in image parts for each sheet) is subtracted by the output total area (the product between the number of output sheets and the total number of dots including image parts and non-image parts corresponding to the image forming area per one sheet), thereby calculating the average printing ratio per one output sheet.

Next, it is determined whether or not the calculated average printing ratio is less than a predetermined threshold value. At this time, if it is determined that the calculated average printing ratio is equal to or more than the threshold value, the toner is consumed by a certain degree, thus it is determined that there is not a possibility of deterioration in the toner, and then the toner ejection control is terminated.

In contrast, if it is determined that the calculated average printing ratio is not equal to or more than the threshold value, that is, if it is determined that the average printing ratio is less than the threshold value, it is determined that deterioration in the toner is in progress, and thus the amount of ejected toner corresponding to the average printing ratio is calculated. At this time, as the method of calculating the amount of ejected toner, if the average printing ratio is small, the method of obtaining the amount of ejected toner, which is larger than that in a case where the average printing ratio is large, may be adopted. In addition, by finding the calculation expression in advance for calculating the relationship between the average printing ratio and the amount of ejected toner, the calculation may be made on the basis of the calculation expression. In addition, by dividing the average printing ratio into several groups in advance, the respective amounts of ejected toner corresponding to the respective groups may be determined in advance.

Then, when the amount of ejected toner is calculated, by controlling the charging device 22, the exposure device 23, the developing device 24, and the transfer device 25, an electrostatic latent image for ejection corresponding to the calculated amount of ejected toner is formed on the photoconductor 21, and the toner ejection operation may be performed in the form of developing the image through the developing device 24. Due to the toner ejection, not only the toner on the developing roller 41, but also the toner adhered onto the supplying roller 42 is consumed, and thus the old toner, which is likely to be deteriorated in the developing device 24, is removed.

Further, the toner, which is ejected onto the photoconductor 21, is cleaned by the cleaning device 26.

Such a toner ejection operation is performed at the timing different from the timing of outputting a normal image. For example, the operation may be appropriately performed in the range, in which the normal image formation is not performed, such as the image output interval or the time of starting or stopping the operation of the image forming apparatus. Further, at the time of performing such a toner ejection operation, in a case where the toner on the photoconductor 21 is cleaned in the cleaning device 26, the transfer device 25 is inactivated such that the toner on the photoconductor 21 is not transferred to the transfer device 25 side. Alternatively, in a case where the transfer device 25 is a contact type, the transfer device 25 may be separated from the photoconductor 21, or the electric field in the direction, in which the toner is not adhered onto the transfer device 25 side, is applied between the transfer device 25 and the photoconductor 21. Furthermore, in the present example, the toner, which is ejected onto the photoconductor 21 by such a toner ejection operation, is removed by the cleaning device 26, but instead of this, for example, the toner may be transferred onto the recording material 28 or may be removed by providing a different cleaning device.

The present exemplary embodiment describes a configuration in which the degree of deterioration in the toner is determined by calculating the average printing ratio per one sheet from the amount of toner accumulatively consumed until the predetermined number of output sheets is reached, but the determination on the degree of determination in the toner is not limited to this, and may be made as follows.

For example, from the amount of toner consumed until the activation time of the developing device 24 reaches the predetermined time, the amount of toner per unit time is calculated, and the degree of deterioration in the toner may be determined on the basis of whether or not the amount of toner per unit time is equal to or greater than the predetermined threshold value. In this case, if the amount of toner per unit time is small, the toner ejection operation may be performed.

Further, on the basis of how many outputs with the amounts of consumed toner per one sheet less than the predetermined threshold value are continuous, the degree of deterioration in the toner may be determined. Normally, in the image output in which the photo image output and the character image output are mixed, the average printing ratio is increased by the effect of the photo image output. Hence, for example, in most of the outputs, if the character image and the photo image are slightly mixed, it is conceivable that the outputs with small printing ratios may be continuous. Consequently, by detecting the state in which the outputs with small amounts of consumed toner are continuous in the number of output sheets, it is determined that there is a possibility of deterioration in the toner if the outputs are excessively continuous. In such a manner, the toner ejection may be performed.

Furthermore, an environmental condition may be added to the degree of deterioration in the toner.

Modified Embodiment of Adhesion Mechanism

The present exemplary embodiment employs the following configuration: in the adhesion mechanism 90, by using the elastic sheet 92 as the guiding member 91, one end side of the elastic sheet 92 is fixed, and the other end side is pressed in contact with the circumferential surface of the supplying roller 42. However, the exemplary embodiment is not limited to this, and may be appropriately modified in design like Modified Embodiments 1-1 to 1-3 shown in FIGS. 10A to 10C.

Modified Embodiment 1-1

Figure 10A:
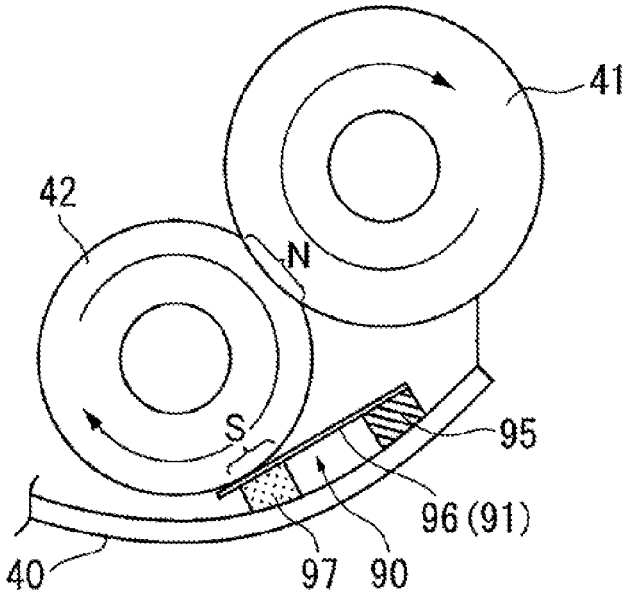
FIGS. 10A to 10C are explanatory diagrams illustrating modified configurations of an adhesion mechanism used in the present exemplary embodiment.

In the adhesion mechanism 90 shown in FIG. 10A, one end of a sheet member 96 is fixed onto the adhering target member 95 by using the sheet member 96 which is bendable as the guiding member 91, and the free end side is pressed in contact with the supplying roller 42. Further, an urging member 97, which urges the sheet member 96 in a direction of tightly pressing it toward the supplying roller 42 side, is provided between the portion of the sheet member 96, which corresponds to the pressure contact portion S coming into contact with the supplying roller 42, and the inner wall of the development container 40. Here, an elastic member, a plate spring, or the like may be used as the urging member 97.

By using such an urging member 97, a condition of pressure contact of the sheet member 96 to the supplying roller 42 is kept substantially constant. Thereby, the separated toner, which reaches the pressure contact portion S of the sheet member 96, is adhered onto the supplying roller 42 by the effect of the more stabilized contact force.

In addition, in Modified Embodiment 1-1, the sheet member 96 may be the elastic sheet 92 used in Exemplary Embodiment 1. However, it is not indispensable for the sheet member 96 itself to be disposed in pressure contact with the supplying roller 42 unlike the elastic sheet 92. Any type of the plate spring made of metal (for example, SUS) or the like may be used if it has at least the surface nature by which the separated toner may be rolled and is bendable by being tightly pressed through the urging member 97.

Modified Embodiment 1-2

Figure 10B:
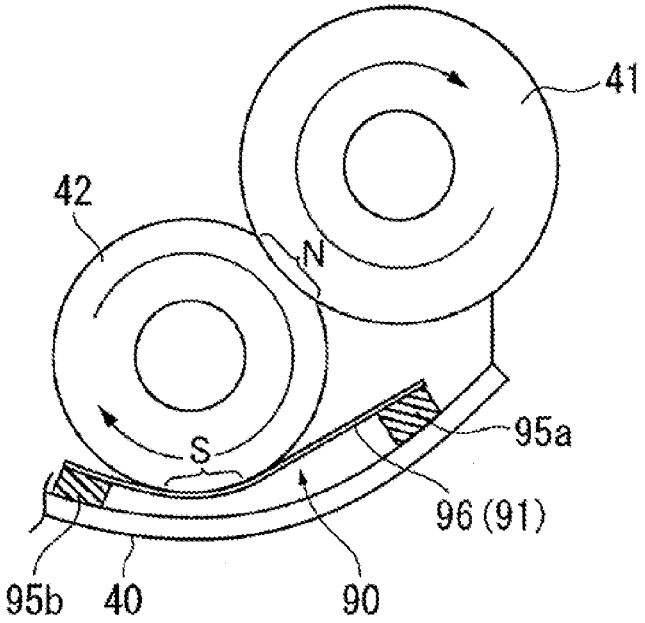

Further, in the adhesion mechanism 90 of FIG. 10B, the sheet member 96 is opposed to the supplying roller 42 so as to extend from the lower region of the contact region N between the supplying roller 42 and the developing roller 41 up to the opposed side region with the lowermost portion of the supplying roller interposed therebetween by using the bendable sheet member 96 as the guiding member 91, both end portions of the sheet member 96 are respectively fixed onto the adhering target members 95 (95*a*, 95*b*) provided in the development container 40, so that the middle portion of the sheet member 96 is pressed in contact with the vicinity of the lowermost of the supplying roller 42. Here, examples of the method of adjusting the contact force of the sheet member 96 include a method of adjusting a state of tension of the sheet member 96 to the adhering target member 95 by using a material, which is elastically deformable in a direction its surface faces, as the sheet member 96.

In the present configuration, the sheet member 96 is provided to stride over the lowermost portion of the supplying roller 42, and thus the pressure contact portion S of the sheet member 96 coming into contact with the supplying roller 42 is secured to be wide. Further, in the present configuration, it is necessary for the upstream side portion of the sheet member 96 in the rotation direction at the lowermost portion of the supplying roller 42 to be inclined obliquely downward from the receiving portion for the separated toner, which corresponds to the lower side of the contact region N between the developing roller 41 and the supplying roller 42, toward the lowermost portion of the supplying roller 42. Thereby, the separated toner, which is received on the sheet member 96, is sufficiently pressed and adhered at the pressure contact portion S between the sheet member 96 and the supplying roller 42.

Modified Embodiment 1-3

Figure 10C:
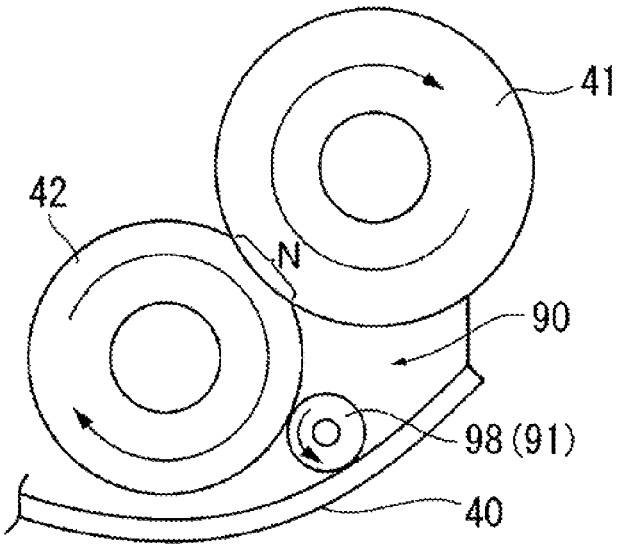

In the adhesion mechanism 90 shown in FIG. 10C, a rotational roller 98, of which the surface is smoothed, as the guiding member 91 is used, and the rotational roller 98 is disposed to be pressed in contact with the circumferential surface of the supplying roller 42 on the lower side of the contact region N between the developing roller 41 and the supplying roller 42, so that the rotational roller 98 is driven to be rotated by following the rotation of the supplying roller 42.

In the present example, the region, which is positioned to be closer to the supplying roller 42 than the uppermost portion of the rotational roller 98, on the circumferential surface of the rotational roller 98 is disposed at a position where the separated toner separated from the contact region N between the developing roller 41 and the supplying roller 42 may be received.

In the present example, the rotational roller 98 rotates in accordance with the rotation of the supplying roller 42. Thus, the separated toner, which is separated from the contact region N, falls down on the circumferential surface of the rotational roller 98, is then guided into the pressure contact portion S between the rotational roller 98 and the supplying roller 42, and is adhered onto the supplying roller 42.

Exemplary Embodiment 2

Figure 11A:
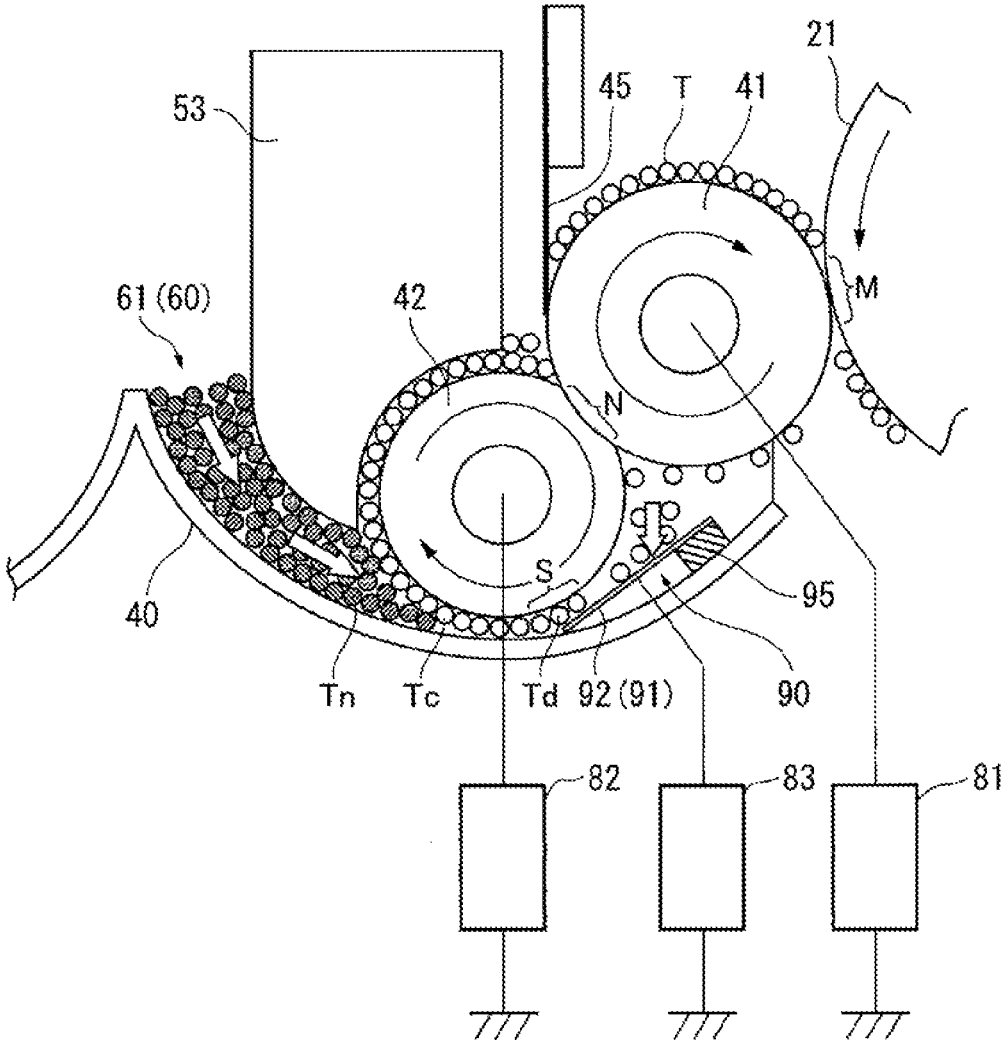
FIG. 11A is an explanatory diagram illustrating a principal part of a developing device according to Exemplary Embodiment 2.

FIG. 11A shows a principal part of a developing device according to Exemplary Embodiment 2.

In the drawing, the basic configuration of the developing device 24 is substantially the same as that of Exemplary Embodiment 1, but the developing device 24 has an adhesion mechanism 90 different from that of Exemplary Embodiment 1. It should be noted that the components that are the same as those of Exemplary Embodiment 1 are represented by the same reference numerals and signs, and the detailed description is omitted herein.

In the adhesion mechanism 90 of the present example, in a substantially similar manner to Exemplary Embodiment 1, the elastic sheet 92 having a cantilever supporting structure is used as the guiding member 91. However, in addition, in order to apply an attracting electric field which gives the conductivity to the elastic sheet 92 and is capable of attracting the toner T interposed between the elastic sheet 92 and the supplying roller 42 to the supplying roller 42 side, an attracting power source 83, which is capable of applying an attraction voltage for generating the attracting electric field, is connected to the elastic sheet 92.

In the present example, for example, a sheet, of which the volume resistivity determined in advance by distributing conductive filler is adjusted, may be used as the elastic sheet 92. Further, the attracting electric field may be appropriately set in terms of further prompting the adsorptive property of the toner in a range in which an undesired discharge does not occur between the supplying roller 42 and the elastic sheet 92 in consideration of the balance between the field and the supplying voltage applied to the supplying roller 42.

Figure 11B:
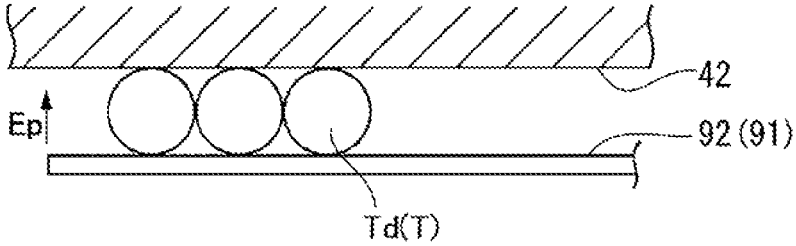
FIG. 11B is an explanatory diagram illustrating the action thereof.

In the present exemplary embodiment, as shown in FIGS. 11A and 11B, the attracting power source 83 applies an attracting electric field Ep (an electric field by which the polarity direction of the elastic sheet 92 side is the charge polarity of the toner) of the direction, in which the toner is attracted toward the supplying roller 42, between the supplying roller 42 and the elastic sheet 92. Hence, the separated toner Td (T), which reaches the pressure contact portion S of the elastic sheet 92, is subjected to the force in the direction in which the toner is attracted by the electric field applied to the supplying roller 42 side, and is further strongly rubbed between both of them. Thereby, the separated toner Td on the elastic sheet 92 is further strongly electrically charged, and is highly likely to be adhered onto the supplying roller 42. As a result, the separated toner Td is stably held on the supplying roller 42, and is transported toward the replenishment region X (the portion corresponding to the developing chamber side opening 66 of the toner transporting path 61) of the toner replenishing mechanism 60 by the rotation of the supplying roller 42.

In addition, the present exemplary embodiment describes a configuration in which the entire elastic sheet 92 is formed to be electrically conductive. However, the exemplary embodiment is not limited to this, and the elastic sheet 92 may have the following laminated structure: the side of the elastic sheet 92 facing the supplying roller 42 is formed as a high resistance layer with a volume resistivity of for example $10^9$ Ωcm or more, and the opposite side thereof is formed as a conductive layer. In this case, the magnitude of the attracting voltage of the attracting power source 83 may be set to be larger than that in the case where the entire elastic sheet 92 is formed to be electrically conductive, as there is provided the high resistance layer. Further, due to the attracting power source 83, the high resistance layer tends to be electrically polarized, and thus it may also be expected that the elastic sheet 92 is more likely to be attracted toward the supplying roller 42. Furthermore, the present exemplary embodiment describes the adhesion mechanism 90 that employs the cantilever-supporting-type elastic sheet 92 as the guiding member 91. However, the exemplary embodiment is not limited to this, and it is needless to say that the configurations such as Modified Embodiments 1-1 to 1-3 mentioned above may be adopted.

Exemplary Embodiment 3

Figure 12A:
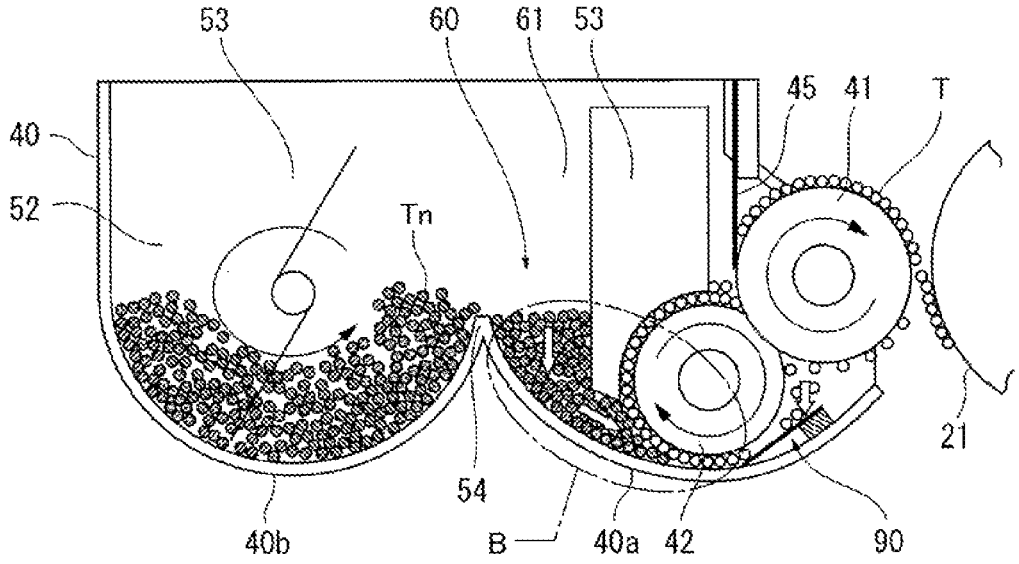
FIG. 12A is an explanatory diagram illustrating a principal part of a developing device according to Exemplary Embodiment 3.

FIG. 12A shows a principal part of a developing device according to Exemplary Embodiment 3.

In the drawing, the basic configuration of the developing device 24 is substantially the same as that of Exemplary Embodiment 1, but is different from that of Exemplary Embodiment 1 in the structure of the toner transporting path 61 in the toner replenishing mechanism 60. It should be noted that the components that are the same as those of Exemplary Embodiment 1 are represented by reference numerals and signs the same as those of Exemplary Embodiment 1, and the detailed description is omitted herein.

Figure 12B:
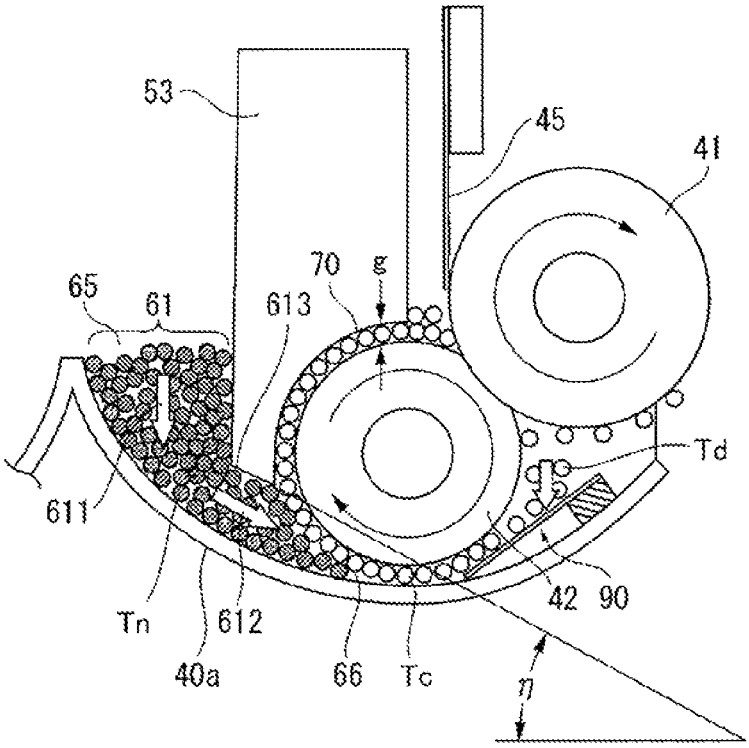
FIG. 12B is an explanatory diagram illustrating a detail of the B part shown in FIG. 12A.

In the present exemplary embodiment, the toner transporting path 61 is the same as that of Exemplary Embodiment 1 in that, as shown in FIGS. 12A and 12B, the developing chamber side opening 66 is disposed below the containing chamber side opening 65. However, the shape thereof is different from that of Exemplary Embodiment 1 in that there are provided a longitudinal passage 611, which extends in the longitudinal direction along the substantially vertical direction, and a lateral passage 612 which is bent from the longitudinal passage 611 and extends in the lateral direction toward the supplying roller 42.

In the present example, as the height of the longitudinal passage 611 increases, the pressure, applied to the circumferential surface of the supplying roller 42 at the interface (as a wall) by the toner remaining portion of the new toner Tn, increases. Further, as the width of the cross section of the shape of the longitudinal passage 611 becomes larger on the upper side, the capacity of the new toner Tn filled in the longitudinal passage 611 becomes larger. Thus, even in such a configuration, it is possible to increase the pressure applied by the toner remaining portion of the new toner Tn at the interface.

Further, the lateral passage 612 is curved and extends in a desired direction from the longitudinal passage 611 such that the interface is formed by the toner remaining portion of the new toner Tn at the portion opposed to the circumferential surface of the supplying roller 42.

Further, the toner transporting path 61 is formed to be partitioned by the partitioning member 53 between the partitioning member 53 and a curved portion 40*a* which is a part of the bottom wall of the development container 40, the upper wall of the partitioning member 53, which partitions the upper side of the lateral passage 612, is inclined obliquely downward from the longitudinal passage 611 toward the supplying roller 42, and the inclination angle n to the lateral direction is set to be equal to or less than the angle of repose of the used toner.

Here, the angle of repose of the toner is an indicator representing the fluidity. In the present configuration, the inclination angle r of the upper wall of the lateral passage 612 is set to be equal to or less than the angle of repose of the used toner in the lateral direction. Hence, correspondingly, the toner particles in the toner remaining portion of the new toner Tn filled in the lateral passage 612 are unlikely to flow, and there is an effect to relax the excess pressure from the longitudinal passage 611. Thus, it is possible to adjust the supply pressure applied to the supplying roller 42 of the new toner Tn on the basis of the combination between the inclination angle q, the length of the lateral passage 612, and the height of the longitudinal passage 611.

Furthermore, in the present exemplary embodiment, the bend portion 613 of the partitioning member 53 between the longitudinal passage 611 and the lateral passage 612 is formed in a shape having a corner. However, in terms of minimizing the moving resistance of the new toner Tn which remains in the range from the longitudinal passage 611 to the lateral passage 612, the bend portion 613 may be formed in a curved shape.

Exemplary Embodiment 4

Figure 13:
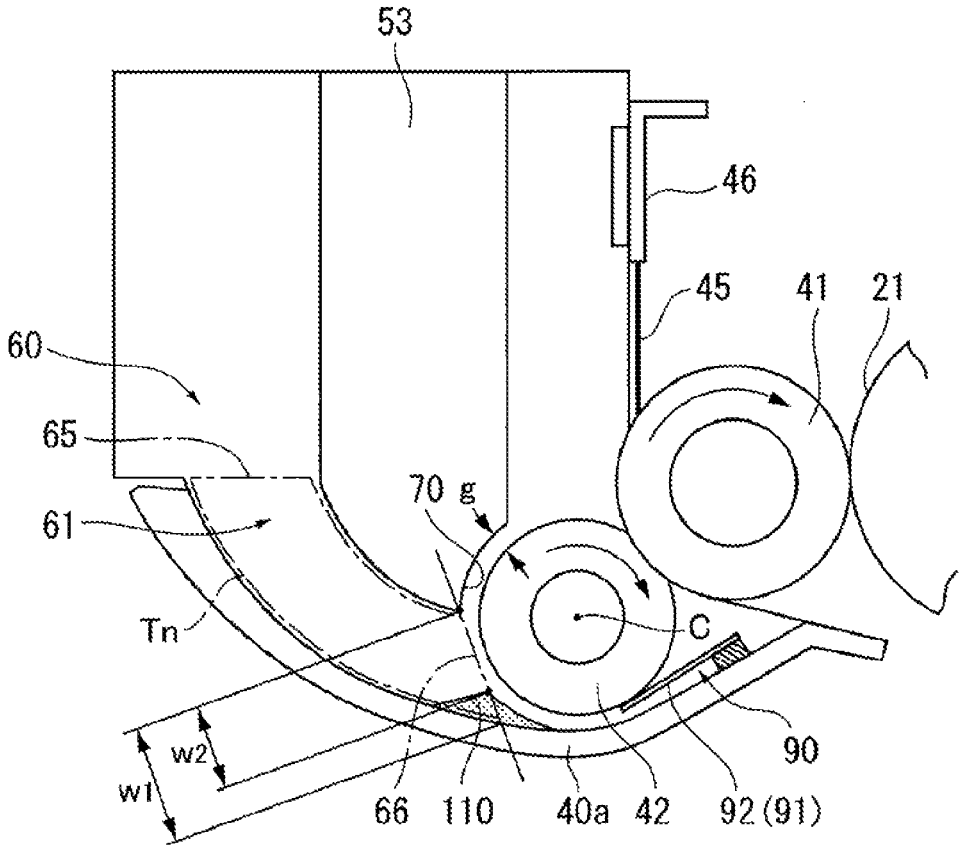
FIG. 13 is an explanatory diagram illustrating a principal part of a developing device according to Exemplary Embodiment 4.

FIG. 13 shows a principal part of a developing device according to Exemplary Embodiment 4.

In the drawing, the basic configuration of the developing device 24 is substantially the same as that of Exemplary Embodiment 1, but is partially different from that of Exemplary Embodiment 1 in the structure of the toner transporting path 61 in the toner replenishing mechanism 60. It should be noted that the components that are the same as those of Exemplary Embodiment 1 are represented by reference numerals and signs the same as those of Exemplary Embodiment 1, and the detailed description is omitted herein.

In the present example, in a substantially similar manner to Exemplary Embodiment 1, the toner transporting path 61 is formed between the partitioning member 53 and the curved portion 40*a* as a part of the bottom wall of the development container 40. In addition, the containing chamber side opening 65 is positioned above the developing chamber side opening 66, and is formed in a shape which is curved along the curved portion 40*a* from the containing chamber 52 toward the developing chamber 51.

Here, the width w1 of the developing chamber side opening 66 of the toner transporting path 61 along the rotation direction of the supplying roller 42 is set to be smaller than the outer diameter d (refer to FIG. 5) of the supplying roller 42 on the projection plane viewed from the supplying roller 42. However, the developing chamber side opening 66 is provided to reach the upper side of the center position C of the supplying roller 42, contrary to Exemplary Embodiment 1. However, the regulating surface 70, which is opposed to the supplying roller 42 and has a curved shape along the circumferential surface of the supplying roller 42 with the gap g interposed therebetween, is formed on the partitioning member 53 adjacent to the developing chamber side opening 66, in a similar manner to Exemplary Embodiment 1.

In the present exemplary embodiment, in a substantially similar manner to Exemplary Embodiment 1, the new toner Tn, which remains in the toner transporting path 61, is pressed slightly obliquely downward from the developing chamber side opening 66, while the old toner Tc, which is captured on the supplying roller 42, is moved by rotation from the bottom toward the top at the portion facing the developing chamber side opening 66. Thereby, it may be observed that the old and new toners come into contact.

When the phenomenon of the contact between the old and new toners repeatedly occurs as the toners are used with the passage of time, in the vicinity of the lower edge of the developing chamber side opening 66 of the toner transporting path 61, there is a location in which the toner remaining portion of the new toner Tn and the old toner Tc captured on the supplying roller 42 are merged. In this case, the pressure is applied onto the circumferential surface of the supplying roller 42 by the own weight of the toner remaining portion of the new toner Tn, while the toner remaining portion of the new toner Tn is tightly pressed by the rotational force of the old toner Tc which is captured on the supplying roller 42. Hence, both toners are gradually accumulated and solidified in a soft blocking shape at the location at which both of them are merged, thereby forming a substantially triangular accumulation wall 110 (so-called dead toner) by the toners.

As described above, when the accumulation wall 110 is formed by the toners in the vicinity of the lower edge of the developing chamber side opening 66 of the toner transporting path 61 as the toners are used with the passage of time, the old toner Tc, which is captured on the supplying roller 42, collides against the accumulation wall 110 immediately after the toner reaches the developing chamber side opening 66. Thus, the old toner Tc is further effectively prevented from reversely flowing toward the toner transporting path 61.

Further, when the accumulation wall 110 is formed by these toners, the width of the developing chamber side opening 66 is originally set to w1, and is practically changed to w2 (w2<w1) in accordance with the formation of the accumulation wall 110. Hence, it is preferable to perform design in consideration of the situation where the accumulation wall 110 is formed by the toners.

In addition, though the accumulation wall 110 is formed by the toners as the toners are used with the passage of time, it is apparent that a partitioning member corresponding to the accumulation wall 110 formed by the new toner Tn may be separately provided in the development container 40.

Further, in the present exemplary embodiment, the developing chamber side opening 66 of the toner transporting path 61 is formed to reach the upper side of the center position C of the supplying roller 42. However, when the width w1 (or w2) of the developing chamber side opening 66 along the rotation direction of the supplying roller 42 is set to be smaller than the outer diameter d of the supplying roller 42 on the projection plane viewed from the supplying roller 42, the new toner Tn, which remains in the toner transporting path 61, collides against the circumferential surface of the supplying roller 42 facing the developing chamber side opening 66.

Therefore, compared with the configuration of the developing chamber side opening 66 with a width which is equal to or greater than the outer diameter d of the supplying roller 42, the new toner Tn within the toner transporting path 61 is prevented from directly leaking into the developing chamber 51.

In particular, in the present example, the predetermined regulating surface 70 is formed on the partitioning member 53. Therefore, even if the extra toner follows the toner captured on the circumferential surface of the supplying roller 42, the extra toner is removed by the regulating surface 70 of the partitioning member 53. Hence, the amount of toner captured on the circumferential surface of the supplying roller 42 is regulated by the regulating surface 70.

Exemplary Embodiment 5

Figure 14A:
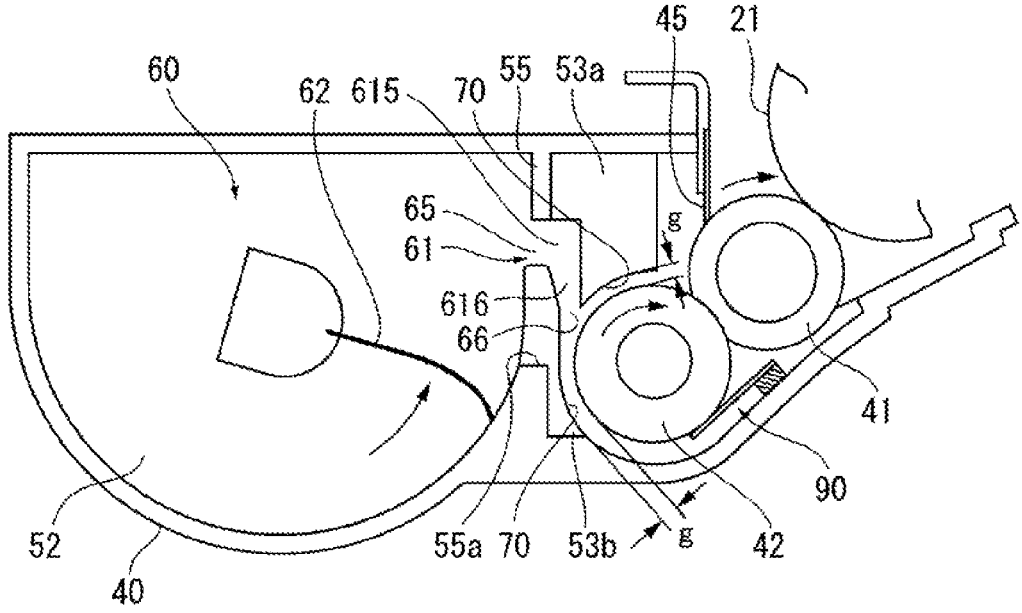
FIG. 14A is an explanatory diagram illustrating a principal part of a developing device according to Exemplary Embodiment 5.

FIG. 14A shows a principal part of a developing device according to Exemplary Embodiment 5.

In the drawing, the basic configuration of the developing device 24 is substantially the same as that of Exemplary Embodiment 1, but is different from that of Exemplary Embodiment 1 in the partition structure of the developing chamber 51 and the toner replenishing mechanism 60. It should be noted that the components that are the same as those of Exemplary Embodiment 1 are represented by reference numerals and signs the same as those of Exemplary Embodiment 1, and the detailed description is omitted herein.

In the present example, the development container 40 is divided into the developing chamber 51 and the containing chamber 52 for the new toner Tn through the division wall 55, and an opening 55*a* is provided on the division wall 55.

In addition, in the vicinity of the opening 55*a* of the division wall 55 of the developing chamber 51 in the development container 40, a downstream side partitioning member 53*a* is provided on the downstream side in the rotation direction of the supplying roller 42, and an upstream side partitioning member 53*b* is provided on the upstream side in the rotation direction of the supplying roller 42.

Here, the upstream side partitioning member 53*b* is mounted on the portion on the upper side of the opening 55*a* of the division wall 55, and is disposed to face the opening 55*a* and protrude toward the supplying roller 42.

In contrast, the downstream side partitioning member 53*a* is mounted on the portion on the lower side of the opening 55*a* of the division wall 55, and is disposed to face the supplying roller 42 and protrude into the opening 55*a*.

In the present example, the toner replenishing mechanism 60 has the toner transporting path 61 connected to the containing chamber 52, and the agitator 62 is provided in the containing chamber 52. The toner transporting path 61 is formed between the upstream side partitioning member 53*b* and the downstream side partitioning member 53*a*, and has a lateral passage 615, which extends in the lateral direction along the substantially horizontal direction so as to face the containing chamber 52, and a longitudinal passage 616 which is bent from the lateral passage 615 and extends in the longitudinal direction along the substantially vertical direction toward the supplying roller 42. In addition, the developing chamber side opening 66 corresponding to the outlet of the longitudinal passage 616 is disposed below the containing chamber side opening 65 corresponding to the inlet of the lateral passage 615.

Here, the width of the developing chamber side opening 66 along the rotation direction of the supplying roller 42 is set to be smaller than at least the outer diameter of the supplying roller 42 on the projection plane viewed from the supplying roller 42 side. Accordingly, the formation position of the developing chamber side opening 66 may be set to be any position. However, in the present example, the position is set near the slightly upper side of the center position of the supplying roller 42.

Further, in the present example, the regulating surfaces 70, each of which is opposed to the supplying roller 42 and has a curved shape along the circumferential surface of the supplying roller 42 with the gap g interposed therebetween, are respectively formed on the portions of the downstream side partitioning member 53*a* and the upstream side partitioning member 53*b* adjacent to the developing chamber side opening 66 of the toner transporting path 61. Here, any value of the gap g may be set if the toner layer to be captured on the supplying roller 42 may be regulated by the gap, but in the present example, the gap is set in a range of 0.5 mm to 1.0 mm. In addition, the meanings of the lower limit and the upper limit are substantially the same as those of Exemplary Embodiment 1.

Furthermore, the formation areas of the regulating surfaces 70 of the partitioning members 53*a* and 53*b* may be appropriately set. However, in the present example, the regulating surface 70 of the downstream side partitioning member 53*a* is formed to reach the vicinity of the uppermost portion of the supplying roller 42 from the developing chamber side opening 66 of the toner transporting path 61. In contrast, the regulating surface 70 of the upstream side partitioning member 53*b* is formed to reach the vicinity of the downstream of the lowermost portion in the rotation direction of the supplying roller 42 without reaching the lowermost portion of the supplying roller 42 from the developing chamber side opening 66 of the toner transporting path 61.

Figure 14B:
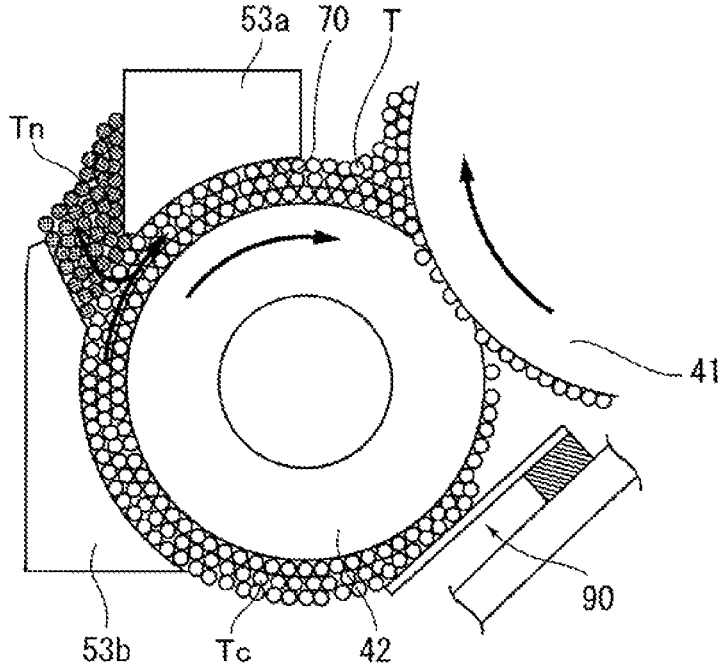
FIG. 14B is an explanatory diagram illustrating a behavior of the toner around the supplying roller in the same developing device.

Accordingly, in the present exemplary embodiment, the toner replenishing mechanism 60 has the following structure: the new toner Tn within the containing chamber 52 is transported to the toner transporting path 61 by the agitator 62, whereby the new toner Tn is filled in the toner transporting path 61 in a state where the toner remains therein (refer to FIG. 14B).

Hence, also in the present exemplary embodiment, the separated toner is adhered onto the circumferential surface of the supplying roller 42 by the adhesion mechanism 90.

Therefore, the supplying roller 42 does not transport the new toner Tn but transports again the old toner Tc in a state where the toner is captured. In this state, when the old toner Tc captured on the supplying roller 42 reaches the portion facing the developing chamber side opening 66 of the toner transporting path 61, in a similar manner to Exemplary Embodiment 1, the remaining toner portion of the new toner Tn in the toner transporting path 61 presses the circumferential surface of the supplying roller 42 by its own weight. Therefore, the interface formed by the remaining toner portion of the new toner Tn in the toner transporting path 61 serves as a wall. Thus, the old toner Tc, which is captured on the supplying roller 42, is transported along the circumferential surface of the supplying roller 42 without leaking into the new toner Tn of the toner transporting path 61. Further, when the old toner Tc is sufficiently captured on the circumferential surface of the supplying roller 42, the new toner Tn is not replenished from the toner transporting path 61. When the old toner Tc captured on the circumferential surface of the supplying roller 42 is insufficient, the new toner Tn, which remains in the toner transporting path 61, is replenished at the location, at which the old toner Tc is not captured, on the circumferential surface of the supplying roller 42.

Further, in the present exemplary embodiment, as shown in FIG. 14B, the regulating surfaces 70, each of which is for regulating the amount of toner captured on the supplying roller 42, are respectively formed on the partitioning members 53*a* and 53*b* with the developing chamber side opening 66 of the toner transporting path 61 interposed therebetween. Hence, the toner, which is captured on the supplying roller 42, is transported only up to the range regulated by each regulating surface 70, and the extra toner passing the regulating surface 70 is removed.

Hence, in the present example, the amount of the old toner Tc, which is adhered onto the supplying roller 42 by the adhesion mechanism 90 and is transported again, is regulated by the regulating surface 70 of the upstream side partitioning member 53*b*, and the regulated amount of the old toner Tc is moved in front of the developing chamber side opening 66 of the toner transporting path 61 by the rotation of the supplying roller 42, and is regulated by the regulating surface 70 of the downstream side partitioning member 53*a*. At this time, even when the extra new toner Tn is intended to follow the circumferential surface of the supplying roller 42 at the portion facing the developing chamber side opening 66, the toner is removed by the regulating surface 70.

As described above, in the present exemplary embodiment, the toner containing space within the developing chamber 51 is restricted by the partitioning members 53*a* and 53*b*. When the toner containing space substantially corresponding to the amount of toner which may be transported by the supplying roller 42 is restricted, the space in which the stressed toner is spread and accumulated is removed in the developing chamber 51. Hence, even when the new toner Tn is replenished, so far as the old toner Tc is sufficiently captured around the supplying roller 42, the new toner Tn is not replenished. Hence, the old and new toners are unlikely to be unnecessarily mixed around the supplying roller 42, and charging distribution of the toner caused by unnecessary mixture of the old and new toners is unlikely to be broadened by the charging blade 45.

Exemplary Embodiment 6

Figure 15:
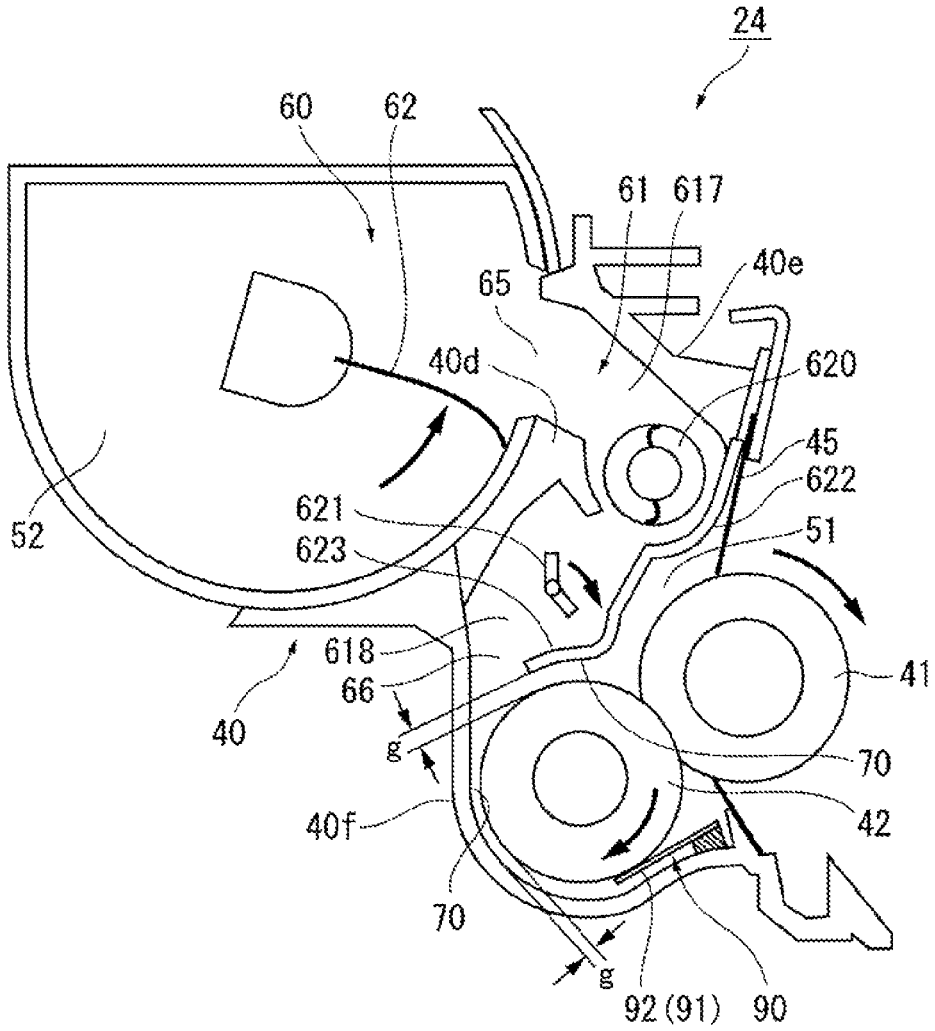
FIG. 15 is an explanatory diagram illustrating a principal part of a developing device according to Exemplary Embodiment 6.

FIG. 15 shows a principal part of a developing device according to Exemplary Embodiment 6.

In the drawing, the basic configuration of the developing device 24 is substantially the same as that of Exemplary Embodiment 5, but is different from that of Exemplary Embodiment 5 in the shape of the development container 40, and the members forming the toner replenishing mechanism 60 and the regulating surface 70. It should be noted that the components that are the same as those of Exemplary Embodiment are represented by reference numerals and signs the same as those of Exemplary Embodiment 5, and the detailed description is omitted herein.

In the present exemplary embodiment, the development container 40 has the developing chamber 51, and the containing chamber 52 which contains the new toner. However, contrary to Exemplary Embodiment 5, the development container 40 has a structure in which the new toner is replenished in the substantially vertical direction.

Further, the toner replenishing mechanism 60 connects the containing chamber 52 and the developing chamber 51 through the toner transporting path 61, and the agitator 62 is disposed in the containing chamber 52.

In the present example, the toner transporting path 61 has a first passage 617 that extends obliquely downward from the containing chamber side opening 65 and a second passage 618 that is bent from the first passage 617 and extends substantially vertically downward. In the bend portion between the first passage 617 and the second passage 618, a transporting member (in the present example, a configuration in which a spiral blade member is provided around the rotation shaft) 620, by which the new toner transported to the first passage 617 is transported to the second passage 618, is disposed. Further, in the course of the second passage 618, a stirring agitator 621 is disposed, and the developing chamber side opening 66 is provided on the lower portion of the second passage 618.

Here, the toner transporting path 61 is configured such that parts of the circumferential wall of the development container 40 are used as passage forming sections 40*d* and 40*e* and a passage forming member 622 is provided in the development container 40.

In particular, in the present example, the passage forming member 622 is opposed to the passage forming section 40*e* so as to secure the developing chamber side opening 66 between itself and the passage forming section 40*e*. In the present example, since the developing chamber side opening 66 is formed on the portion facing the vicinity of the upstream of the uppermost portion of the supplying roller 42 in the rotation direction, the width of the developing chamber side opening 66 along the rotation direction of the supplying roller 42 is set to be smaller than the outer diameter of the supplying roller 42 on the projection plane viewed from the supplying roller 42 side.

In addition, a counter wall 623, which is opposed to the circumferential surface of the supplying roller 42, is integrally formed in the passage forming member 622 on the downstream side of the developing chamber side opening 66 in the rotation direction of the supplying roller 42. The regulating surface 70, which is opposed to the supplying roller 42 and has a curved shape along the circumferential surface of the supplying roller 42 with the gap g interposed between itself and the supplying roller 42, is formed on the counter wall 623.

Further, in the present example, a part of the circumferential wall of the development container 40, which is opposed to the circumferential surface of the supplying roller 42, is used as a counter wall 40*f* on the upstream side of the developing chamber side opening 66 in the rotation direction of the supplying roller 42. The regulating surface 70, which is opposed to the supplying roller 42 and has a curved shape along the circumferential surface of the supplying roller 42 with the gap g interposed between itself and the supplying roller 42, is formed on the counter wall 40*f*.

Here, any value of the gap g may be set if the toner layer to be captured on the supplying roller 42 may be regulated by the gap g, but in the present example, the gap is set in a range of 0.5 mm to 1.0 mm. In addition, the meanings of the lower limit and the upper limit are substantially the same as those of Exemplary Embodiment 1.

According to the present exemplary embodiment, the toner replenishing mechanism 60 has the following structure: the new toner Tn within the containing chamber 52 is transported to the toner transporting path 61 by the agitator 62, the new toner, which is transported to the first passage 617 of the toner transporting path 61 is transported to the second passage 618 through the transporting member 620, and the new toner, which is transported to the second passage 618, is transported to the developing chamber side opening 66 through the stirring agitator 621, whereby also in this example, the new toner Tn is filled in the toner transporting path 61 in a state where the toner remains therein.

Hence, also in the present exemplary embodiment, in a similar manner to Exemplary Embodiment 5, the remaining toner portion of the new toner in the toner transporting path 61 presses the circumferential surface of the supplying roller 42 by its own weight. Therefore, the interface formed by the remaining toner portion of the new toner in the toner transporting path 61 serves as a wall. Thus, the old toner, which is captured on the supplying roller 42, is transported along the circumferential surface of the supplying roller 42 without leaking into the new toner of the toner transporting path 61. Further, when the old toner is sufficiently captured on the circumferential surface of the supplying roller 42, the new toner is not replenished from the toner transporting path 61. When the old toner captured on the circumferential surface of the supplying roller 42 is insufficient, the new toner, which remains in the toner transporting path 61, is replenished at the location, at which the old toner is not captured, on the circumferential surface of the supplying roller 42.

Further, in the present exemplary embodiment, the regulating surfaces 70, each of which is for regulating the amount of toner captured on the supplying roller 42, are respectively formed on the counter wall 40*f* as a part of the circumferential wall of the development container 40 and the counter wall 623 of the passage forming member 622 with the developing chamber side opening 66 of the toner transporting path 61 interposed therebetween. Hence, the toner, which is captured on the supplying roller 42, is transported only up to the range regulated by each regulating surface 70, and the extra toner passing the regulating surface 70 is removed.

Hence, in the present example, the amount of the old toner, which is adhered onto the supplying roller 42 by the adhesion mechanism 90 and is transported again, is regulated by the regulating surface 70 of the counter wall 40*f* as a part of the circumferential wall of the development container 40, and the regulated amount of the old toner is moved to face the developing chamber side opening 66 of the toner transporting path 61 by the rotation of the supplying roller 42, and is regulated by the regulating surface 70 of the passage forming member 622. At this time, even when the extra new toner Tc is intended to follow the circumferential surface of the supplying roller 42 at the portion facing the developing chamber side opening 66, the toner is removed by the regulating surface 70.

Hence, also in the present exemplary embodiment, in a substantially similar manner to Exemplary Embodiment 5, the toner containing space within the developing chamber 51 is restricted by the counter walls 40*f* and 623. When the toner containing space substantially corresponding to the amount of toner which may be transported by the supplying roller 42 is restricted, the space in which the stressed toner is spread and accumulated is removed in the developing chamber 51.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a transporting unit that rotates while being opposed to an image holding member, which circulates while holding an electrostatic latent image, and that transports a developer toward the image holding member so as to develop the electrostatic latent image on the image holding member;

a supplying unit that has the developer adhered onto a circumferential surface thereof being rotated and that supplies the developer to the transporting unit in contact with the transporting unit; and a replenishing unit that includes a transporting path connected between a containing chamber which contains the developer and a supplying chamber in which the supplying unit is disposed, that keeps the developer, with which the supplying unit is replenished, remaining, and that replenishes the supplying unit with the developer, wherein the replenishing unit is provided with an opening on a developing chamber side of the transporting path facing the supplying unit, and includes a downstream side counter member which is opposed to the supplying unit on a downstream side of the supplying unit in a rotation direction thereof with the opening on the developing chamber side of the transporting path interposed therebetween, wherein the downstream side counter member has a regulating surface, which is curved along the circumferential surface of the supplying unit, with a gap which regulates the developer to be adhered onto the supplying unit, and wherein the downstream side counter member is disposed on an upstream side of a nip of the supplying unit and the transport unit in a direction of rotation of the supplying unit so that the downstream side counter member is disposed between the developing chamber opening and the transporting unit of the rotation direction of the supplying unit.

2. The developing device according to claim 1, wherein an upstream side counter member, which is opposed to the supplying unit on an upstream side of the supplying unit in the rotation direction with the opening on the developing chamber side of the transporting path interposed therebetween, is disposed, and wherein the upstream side counter member has a regulating surface, which is curved along the circumferential surface of the supplying unit, with a gap which regulates the developer to be captured by the supplying unit.

3. The developing device according to claim 1, wherein the opening on the developing chamber side of the transporting path is positioned below the opening on the containing chamber side of the transporting path.

4. The developing device according to claim 2, wherein the opening on the developing chamber side of the transporting path is positioned below the opening on the containing chamber side of the transporting path.

5. The developing device according to claim 1, wherein the gap between the supplying unit and the regulating surface of each counter member opposed to the supplying unit is set to be not less than 0.5 mm and not more than 1 mm.

6. The developing device according to claim 2, wherein the gap between the supplying unit and the regulating surface of each counter member opposed to the supplying unit is set to be not less than 0.5 mm and not more than 1 mm.

7. The developing device according to claim 3, wherein the gap between the supplying unit and the regulating surface of each counter member opposed to the supplying unit is set to be not less than 0.5 mm and not more than 1 mm.

8. The developing device according to claim 1, wherein each counter member opposed to the supplying unit has the regulating surface with a length equal to or greater than a width, which faces the opening on the developing chamber side of the transporting path, along the rotation direction of the supplying unit.

9. The developing device according to claim 2, wherein each counter member opposed to the supplying unit has the regulating surface with a length equal to or greater than a width, which faces the opening on the developing chamber side of the transporting path, along the rotation direction of the supplying unit.

10. The developing device according to claim 3, wherein each counter member opposed to the supplying unit has the regulating surface with a length equal to or greater than a width, which faces the opening on the developing chamber side of the transporting path, along the rotation direction of the supplying unit.

11. The developing device according to claim 4, wherein each counter member opposed to the supplying unit has the regulating surface with a length equal to or greater than a width, which faces the opening on the developing chamber side of the transporting path, along the rotation direction of the supplying unit.

12. The developing device according to claim 5, wherein each counter member opposed to the supplying unit has the regulating surface with a length equal to or greater than a width, which faces the opening on the developing chamber side of the transporting path, along the rotation direction of the supplying unit.

13. The developing device according to claim 6, wherein each counter member opposed to the supplying unit has the regulating surface with a length equal to or greater than a width, which faces the opening on the developing chamber side of the transporting path, along the rotation direction of the supplying unit.

14. The developing device according to claim 7, wherein each counter member opposed to the supplying unit has the regulating surface with a length equal to or greater than a width, which faces the opening on the developing chamber side of the transporting path, along the rotation direction of the supplying unit.

15. The developing device according to claim 1, wherein the opening on the developing chamber side of the transporting path is disposed to be closer to the downstream side of the supplying unit in the rotation direction than a bottom position of the supplying unit and be closer to the upstream side of the supplying unit in the rotation direction than a top position of the supplying unit.

16. The developing device according to claim 2, wherein the opening on the developing chamber side of the transporting path is disposed to be closer to the downstream side of the supplying unit in the rotation direction than a bottom position of the supplying unit and be closer to the upstream side of the supplying unit in the rotation direction than a top position of the supplying unit.

17. An image forming apparatus comprising:

an image holding member that circulates while holding an electrostatic latent image; and the developing device according to claim 1 that is disposed to be opposed to the image holding member and that develops the electrostatic latent image on the image holding member.

18. The image forming apparatus according to claim 17, further comprising:

a control device that is able to control consumption of a developer of the developing device, wherein the control device comprises:

a calculating section which calculates an amount of developer consumed in image forming performed a predetermined times, a determining section which determines whether or not the amount of developer calculated in the calculating section is greater than or equal to a predetermined threshold value, an ejecting section which ejects the developer within the developing device toward the image holding member by a predetermined amount when the amount of developer determined in the determining section is less than the predetermined threshold value, and a cleaning processing section that cleans the developer, which is ejected from the ejecting section, on the image holding member.

19. A developing device comprising:

a transporting unit that rotates while being opposed to an image holding member, which circulates while holding an electrostatic latent image, and that transports a developer toward the image holding member so as to develop the electrostatic latent image on the image holding member;

a supplying unit that has the developer adhered onto a circumferential surface thereof being rotated and that supplies the developer to the transporting unit in contact with the transporting unit; and a replenishing unit that includes a transporting path connected between a containing chamber which contains the developer and a supplying chamber in which the supplying unit is disposed, that keeps the developer, with which the supplying unit is replenished, remaining, and that replenishes the supplying unit with the developer, wherein the replenishing unit is provided with an opening on a developing chamber side of the transporting path facing the supplying unit, and includes a downstream side counter member which is opposed to the supplying unit on a downstream side of the supplying unit in a rotation direction thereof with the opening on the developing chamber side of the transporting path interposed therebetween, wherein the downstream side counter member has a regulating surface, which is curved along the circumferential surface of the supplying unit, with a gap which regulates the developer to be adhered onto the supplying unit, and wherein the gap between the supplying unit and the regulating surface of each counter member opposed to the supplying unit is set to be not less than 0.5 mm and not more than 1 mm.

20. A developing device comprising:

a transporting unit that rotates while being opposed to an image holding member, which circulates while holding an electrostatic latent image, and that transports a developer toward the image holding member so as to develop the electrostatic latent image on the image holding member;

a supplying unit that has the developer adhered onto a circumferential surface thereof being rotated and that supplies the developer to the transporting unit in contact with the transporting unit; and a replenishing unit that includes a transporting path connected between a containing chamber which contains the developer and a supplying chamber in which the supplying unit is disposed, that keeps the developer, with which the supplying unit is replenished, remaining, and that replenishes the supplying unit with the developer, wherein the replenishing unit is provided with an opening on a developing chamber side of the transporting path facing the supplying unit, and includes a downstream side counter member which is opposed to the supplying unit on a downstream side of the supplying unit in a rotation direction thereof with the opening on the developing chamber side of the transporting path interposed therebetween, wherein the downstream side counter member has a regulating surface, which is curved along the circumferential surface of the supplying unit, with a gap which regulates the developer to be adhered onto the supplying unit, and wherein each counter member opposed to the supplying unit has the regulating surface with a length equal to or greater than a width, which faces the opening on the developing chamber side of the transporting path, along the rotation direction of the supplying unit.

* * * * *